US008672056B2

(12) United States Patent
Clark et al.

(10) Patent No.: US 8,672,056 B2
(45) Date of Patent: Mar. 18, 2014

(54) SYSTEM AND METHOD FOR CONTROLLING STEERING IN A ROTARY STEERABLE SYSTEM

(75) Inventors: Brian Clark, Sugar Land, TX (US); Geoffrey C. Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 371 days.

(21) Appl. No.: 12/977,231

(22) Filed: Dec. 23, 2010

(65) Prior Publication Data

US 2012/0160563 A1 Jun. 28, 2012

(51) Int. Cl.
*E21B 7/06* (2006.01)
*E21B 7/00* (2006.01)

(52) U.S. Cl.
CPC *E21B 7/062* (2013.01); *E21B 7/006* (2013.01)
USPC ..... 175/61; 175/73; 175/45

(58) Field of Classification Search
CPC ..... E21B 7/062; E21B 7/006
USPC ..... 137/625.46
See application file for complete search history.

(56) References Cited

U.S. PATENT DOCUMENTS

| | | | | |
|---|---|---|---|---|
| 4,637,479 | A * | 1/1987 | Leising | 175/26 |
| 4,991,667 | A | 2/1991 | Wilkers, Jr. et al. | |
| 5,706,905 | A * | 1/1998 | Barr | 175/61 |
| 6,840,336 | B2 * | 1/2005 | Schaaf et al. | 175/27 |
| 7,942,213 | B2 * | 5/2011 | Sihler | 175/61 |
| 2006/0249287 | A1 * | 11/2006 | Downton et al. | 166/250.1 |
| 2007/0221409 | A1 | 9/2007 | Hall et al. | |

FOREIGN PATENT DOCUMENTS

| | | |
|---|---|---|
| EP | 1264960 | 6/2005 |
| GB | 2423102 | 6/2006 |

OTHER PUBLICATIONS

Search Report from the equivalent GB patent application No. 21958.1 issued on Mar. 21, 2012.

* cited by examiner

*Primary Examiner* — Jennifer H Gay
*Assistant Examiner* — Caroline Butcher
(74) *Attorney, Agent, or Firm* — Chadwick A. Sullivan; Brigitte Echols

(57) ABSTRACT

A system and methodology provide control over the directional drilling of a wellbore. A rotational valve is mounted within a drill collar of a rotary steerable system to enable selective actuation of one or more steering pads on the drill collar via an actuating fluid. The rotational valve is controlled via a motor and designed to provide enhanced control over the flow of actuating fluid to the steering pads.

20 Claims, 26 Drawing Sheets

SYSTEM AND METHOD FOR CONTROLLING STEERING IN A ROTARY STEERABLE SYSTEM

BACKGROUND

A variety of valves are used to control flow of actuating fluids in many well applications and other flow control applications. For example, valves are employed in wellbore drilling applications to control the actuation of tools located in the wellbore being drilled. During wellbore drilling operations, valves positioned in a drilling assembly can be selectively actuated to control the direction of drilling. The valves may be positioned, for example, to control the flow of drilling mud to actuating pads which are extended and contracted in a controlled manner to steer the drill bit and thereby drill the wellbore in a desired direction.

In some drilling applications, rotary steerable systems are employed to control the direction of drilling during formation of the wellbore. The rotary steerable systems may utilize a drill bit coupled with a drill collar and rotated to drill through the rock formation. A plurality of steering pads is selectively actuated in a lateral direction to control the direction of drilling, and the steering pads may be controlled by a variety of valves and control systems. In some applications, rotary valves are held at desired angular orientations with respect to the rotating drill collar to control flow of drilling mud to the steering pads. A rotary valve may be held in a geostationary position by a control cartridge in, for example, a strap-down system. However, existing systems are limited in their ability to accurately control the direction of drilling and in providing options for changing the direction of drilling. Existing strap-down systems use a motor to orientate a valve opening but provide no advanced control. The motor either keeps the valve geostationary or allows it to rotate slowly.

SUMMARY

In general, a system and methodology is provided to facilitate control over the directional drilling of a wellbore. A rotational valve is mounted within a drill collar of a rotary steerable system to enable selective actuation of one or more steering pads on the drill collar via an actuating fluid. The rotational valve is controlled via a motor and is designed to provide enhanced control over the flow of actuating fluid to the steering pads.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The embodiments described herein generally relate to a system and method for drilling wellbores. The system and methodology employ a rotary steerable system which may be operated to control the direction of drilling during formation of the wellbore. The rotary steerable system comprises one or more steering pads mounted on a drill collar, and the steering pad or pads are selectively actuated to control the orientation of the drill collar in the direction of drilling. The steering pads are actuated by an actuating fluid, and flow of the actuating fluid to the steering pads is controlled by a rotational valve, e.g. a spider valve, which is operated by a controlled motor.

According to one embodiment, a motor controlled spider valve is used in combination with orientation sensors and a controller, e.g. microprocessor, to enable improved control of the rotary steerable system. For example, operation of the spider valve may be controlled to provide an "off" position which allows the rotary steerable system to direct drilling of a straight section of wellbore. In this example, the off position is enabled by the design of the spider valve which allows all of the actuating pads to be simultaneously activated by the pressure of the actuating fluid, e.g. drilling mud.

Figure 1:
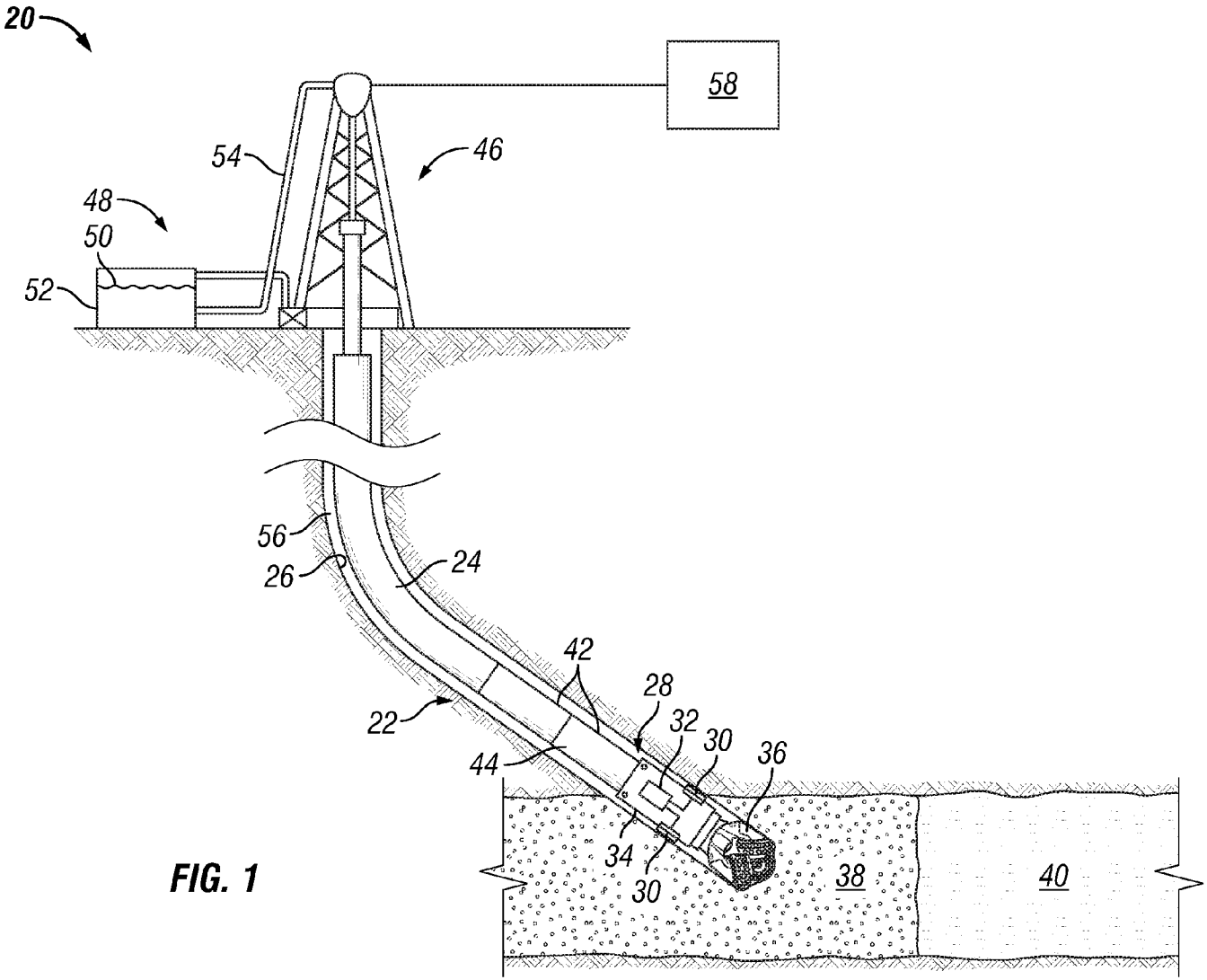
FIG. 1 is a schematic illustration of an example of a drill string which includes a rotary steerable system employing a rotational valve, according to an embodiment of the present invention.

Referring generally to FIG. 1, an embodiment of a drilling system 20 is illustrated as having a bottom hole assembly 22 which is part of a drill string 24 used to form a desired, directionally drilled wellbore 26. The illustrated drilling system 20 comprises a rotary steerable system 28 having at least one laterally movable steering pad 30 controlled by a valve system 32. By way of example, the steering pads 30 may be designed to act against a corresponding pivotable component of the rotary steerable system 28 or against the surrounding wellbore wall to provide directional control. In this particular embodiment, the valve system 32 is positioned within a drill collar 34 of the rotary steerable system 28. The drill collar 34 is coupled with a drill bit 36 which is rotated to cut through a surrounding rock formation 38 which may be in a hydrocarbon bearing reservoir 40.

Depending on the environment and the operational parameters of the drilling operation, drilling system 20 may comprise a variety of other features. For example, drill string 24 may include additional drill collars 42 which, in turn, may be designed to incorporate desired drilling modules, e.g. logging-while-drilling and/or measurement-while-drilling modules 44. In some applications, stabilizers may be used along the drill string to stabilize the drill string with respect to the surrounding wellbore wall.

Various surface systems also may form a part of the drilling system 20. In the example illustrated, a drilling rig 46 is positioned above the wellbore 26 and a drilling fluid system 48, e.g. drilling mud system, is used in cooperation with the drilling rig 46. For example, the drilling fluid system 48 may be positioned to deliver a drilling fluid 50 from a drilling fluid tank 52. The drilling fluid 50 is pumped through appropriate tubing 54 and delivered down through drilling rig 46 and into drill string 24. In many applications, the return flow of drilling fluid flows back up to the surface through an annulus 56 between the drill string 24 and the surrounding wellbore wall. The return flow may be used to remove drill cuttings resulting from operation of drill bit 38. The drilling fluid 50 also may be used as an actuating fluid to control operation of the rotary steerable system 28 and its movable steering pad or pads 30. In this latter embodiment, flow of the drilling/actuating fluid 50 to steering pads 30 is controlled by valve system 32 in a manner which enables control over the direction of drilling during formation of wellbore 26.

The drilling system 20 also may comprise many other components, such as a surface control system 58. The surface control system 58 can be used to communicate with rotary steerable system 28. In some embodiments, the surface control system 58 receives data from downhole sensor systems and also communicates commands to the rotary steerable system 28 to control actuation of valve system 32 and thus the direction of drilling during formation of wellbore 26. In other applications, as discussed in greater detail below, control electronics are located downhole in the rotary steerable system 28 and the control electronics cooperate with an orientation sensor to control the direction of drilling. However, the downhole, control electronics may be designed to communicate with surface control system 58, to receive directional commands, and/or to relay drilling related information to the surface control system.

Figure 2:
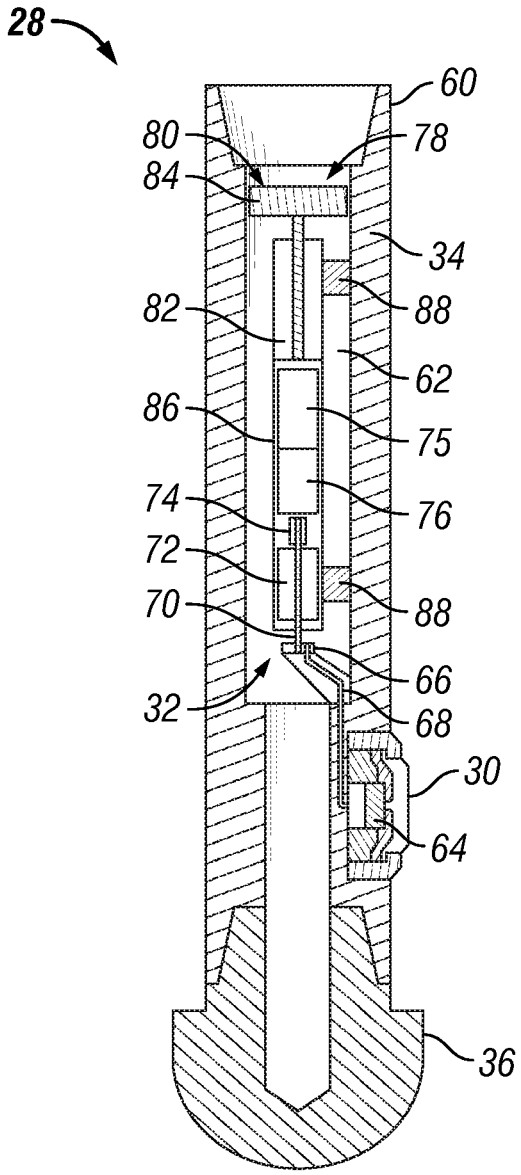
FIG. 2 is a schematic illustration of an example of a rotary steerable system, according to an embodiment of the present invention.

Referring generally to FIG. 2, an illustration is provided of one embodiment of the rotary steerable system 28. In this embodiment, drill bit 36 is mounted to the drill collar 34 which has a connector end 60 opposite drill bit 36. Connector end 60 is designed for coupling the rotary steerable system 28 to the next adjacent, uphole component of drill string 24. Additionally, the drill collar 34 comprises a hollow interior 62 designed to hold a variety of rotary steerable system components. An individual movable steering pad 30 or a plurality of movable steering pads 30 also may be mounted to the drill collar 34 for lateral, e.g. radial movement, with respect to the drill collar. In one example, each steering pad of a plurality of steering pads 30 may be moved by a corresponding piston 64 which is hydraulically actuated via drilling/actuating fluid 50 appropriately metered by valve system 32.

In the example illustrated, valve system 32 comprises a rotational valve 66, such as a spider valve. The spider valve 66 may be selectively rotated to enable flow of actuating fluid 50 to selected individual and/or multiple steering pads 30. By way of example, the actuating fluid 50 may be delivered through hydraulic lines 68 to act against pistons 64. During rotation of drill collar 34 and drill bit 36 for drilling of wellbore 26, the spider valve 66 undergoes a controlled, relative rotation to ensure delivery of the actuating fluid through desired hydraulic line 68 to desired movable steering pads 30.

As illustrated, spider valve 66 is mounted to a drive shaft 70 which is rotated by a motor 72, such as an electric motor. One or more sensors 74, such as an encoder, also may be operatively engaged with drive shaft 70 to monitor the angular orientation of spider valve 66 relative to the drill collar 34. The rotary steerable system 28 further comprises control electronics 75 which may comprise a micro-controller 76, e.g. a microprocessor. The micro-controller 76 receives data from the sensors/encoder 74 and uses the data to control motor 72 which, in turn, controls the angular positioning of spider valve 66. The controller 76 also may be designed for communication with surface control system 58 to receive commands and/or to relay data. Furthermore, control electronics 75 may comprise additional components, such as a direction and inclination package containing magnetometers and accelerometers. Control over the spider valve position enables a unique control over duration of the side forces applied by one or more steering pads 30. The spider valve 66 moves synchronously with the drill collar 34, and the spider valve may be aligned with corresponding ports or blank spaces to control side force duration as discussed in greater detail below.

Electric power may be provided to controller 76, to motor 72, and to other components of rotary steerable system 28 via a suitable power source 78. By way of example, the power source 78 may comprise batteries and/or a turbine 80. The turbine 80 may comprise an alternator 82 driven by rotation of turbine blades 84 which are rotated by the pressurized flow of drilling/actuating fluid 50 down through rotary steerable system 28 and drill bit 36. Several of the features of the rotary steerable system 28 may be mounted within a pressure housing 86 to protect them against the relatively high pressures of the drilling/actuating fluid 50. For example, motor 72, encoder 74, controller 76, and alternator 82 may be disposed within a pressure housing 86. In this embodiment, the pressure housing 86 is rigidly attached to the drill collar 34 with suitable mounting structures 88, e.g. centralizers, disposed in the hollow interior 62 of drill collar 34. Thus, the pressure housing 86 rotates with the drill collar 34.

The rotary steerable system 28 comprises at least one movable steering pad 30, e.g. 1, 2, 3 or 4 movable steering pads, which are activated by the differential pressure between the inside and outside of the drill collar 34. When a particular steering pad 30 is activated and pushes against, for example, the surrounding formation, the rotary steerable system 28 is deflected in the opposite direction and provides the steering capability. As the drill collar 34 rotates, the spider valve 66 is able to selectively open or shut off pads 30 by allowing actuating fluid 50 to enter the selected hydraulic line 68 which delivers the actuating fluid 50 to the piston 64 behind the corresponding steering pad 30. The spider valve 66 is rotated by shaft 70 which is driven by motor 72 while the shaft encoder (or other sensor) 74 measures the rotational angle of the spider valve 66 relative to the drill collar 34. The shaft encoder 74 is a unique feature and may be mounted on the shaft 70 to allow the controller 76 or other processor to track the orientation of the spider valve 66 with respect to the drill collar 34.

By controlling the position of rotational valve 66, e.g. spider valve, with electric motor 72, substantially greater steering capabilities are enabled. For example, the spider valve 66 may be designed to simultaneously open flow of actuating fluid 50 to all of the steering pads 30. Consequently, all of the steering pads are activated simultaneously so that no side force is generated and straight sections of wellbore may be drilled more accurately. In this situation, the activated steering pads 30 function as a near bit, full gauge stabilizer operating in combination with a fixed stabilizer above the rotary steerable system 28 to enable drilling of a straight hole rather than a slightly spiral hole approximating a straight hole. Additionally, the motor controlled spider valve 66 also can be operated and controlled to drill wellbore doglegs of varying build-rates according to several methods, such as varying the duration of the side force during each rotation of the drill collar 34. Also, by extending the movable pads during drilling of straight wellbore sections, the steering pads 30 are not being continually stroked. This leads to greater longevity with respect to piston seals. Effectively, the duty cycle of the steering system is reduced which increases the reliability of the overall rotary steerable system 28.

In FIG. 1, the steering pads 30 are illustrated as acting against a surrounding wellbore wall. However, the rotary steerable system 28 may have a variety of other designs including hybrid designs which include features of both point-the-bit and push-the-bit systems. In such hybrid systems, the hydraulic lines 68 may deliver actuating fluid to corresponding pistons/pads to deflect a stabilizer sleeve. The deflection or pivotable movement of the stabilizer sleeve controls, e.g. changes, the direction of drilling.

Figure 3:
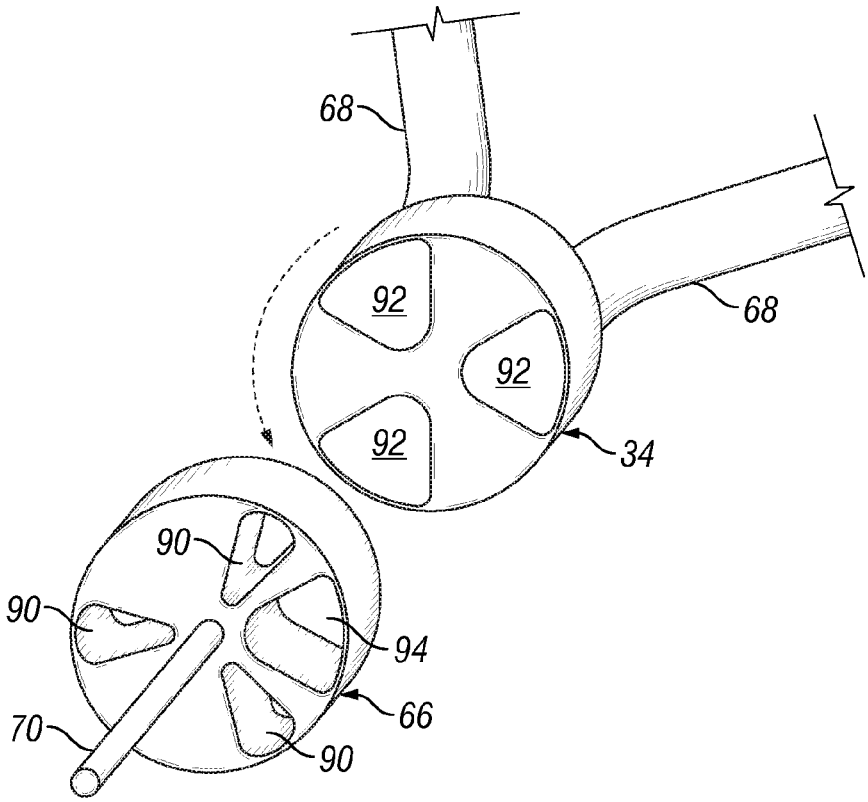
FIG. 3 is an exploded view of a rotational valve or spider valve which controls flow of actuating fluid to a plurality of steering pads via corresponding flow ports, according to an embodiment of the present invention.

Referring generally to FIG. 3, an exploded view of an embodiment of the spider valve 66 and corresponding drill collar ports is illustrated. In this embodiment, the spider valve 66 comprises three valve openings 90 which are located at angular positions which correspond with three ports 92 which are part of and rotate with drill collar 34. The ports 92 deliver actuating fluid 50 into hydraulic lines 68 and on to the corresponding steering pads 30. The spider valve 66 may be selectively rotated via shaft 70 and motor 72 to bring valve openings 90 into alignment or out of alignment with ports 92. To facilitate an understanding of the angular relationship of valve openings 90 with respect to ports 92, the ports 92 have been labeled as first (1), second (2) and third (3) ports. The first (1), second (2) and third (3) ports correspond with first, second and third movable steering pads 30. The spider valve 66 also comprises an additional valve opening 94 which, in this embodiment, is a fourth opening. In this example, the additional valve opening 94 is larger than each of the valve openings 90. The additional valve opening 94 may be selectively aligned with desired ports 92 to control the directional drilling of deviated sections of wellbore 26, as explained in greater detail below. It should be noted a plurality of activating ports 92 is illustrated to facilitate explanation. However, a single port 92 may be employed to control a single steering pad 30. If a single pad 30 and port 92 are employed, the principle remains the same as described with respect to the plurality of pads and ports. Additionally, if certain pads fail to function properly, steering may still be achieved with a pair of pads or with a single pad.

Figure 4:
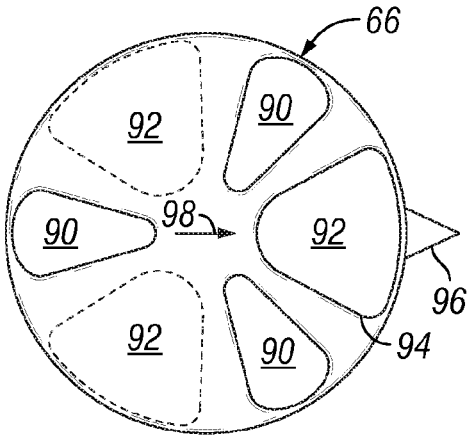
FIG. 4 is a schematic illustration of an operational position of the rotational valve with respect to the flow ports, according to an embodiment of the present invention.
Figure 5:
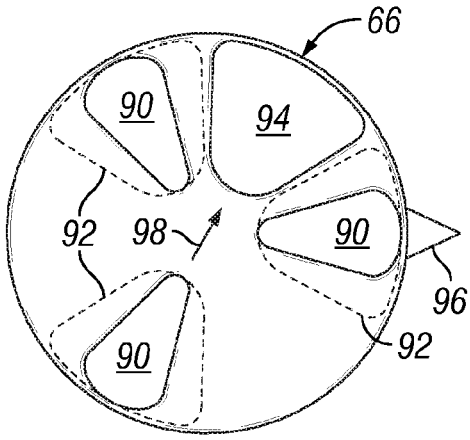
FIG. 5 is a schematic illustration of another operational position of the rotational valve with respect to the flow ports, according to an embodiment of the present invention.

In FIG. 4, a front view of the spider valve 66 is illustrated at a selected angular orientation with respect to drill collar 34 and ports 92. The ports 92 behind spider valve 66, i.e. the ports closed by spider valve 66, are shown in dashed lines. In this example, the larger, additional valve opening 94 is aligned with the first (1) port 92 to allow flow of pressurized actuating fluid 50 to the first steering pad 30. Flow through valve openings 90 as well as through second (2) and third (3) ports 92 is blocked. FIG. 4 and subsequent figures employ a triangular marker 96 which indicates the rotational angle of the drill collar 34 and its ports 92. Similarly, an arrow marker 98 is employed to indicate the rotational angle of the spider valve 66. In FIG. 5, the relative angular position of spider valve 66 has been changed with respect to ports 92 so that the three valve openings 90 are aligned with the three ports 92 to enable simultaneous flow to all three of the movable steering pads 30 via hydraulic lines 68.

Figure 6A:
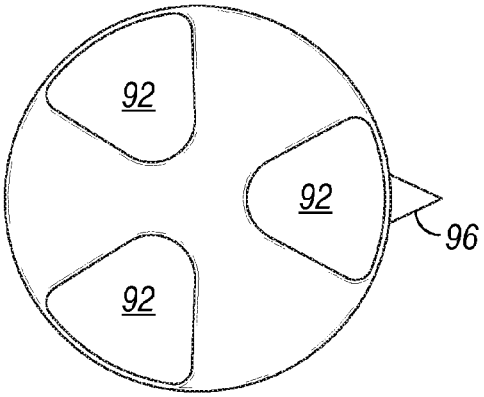
FIG. 6 is a schematic illustration showing the angular position of valve openings through the rotational valve and the angular position of flow ports, according to an embodiment of the present invention.
Figure 6B:
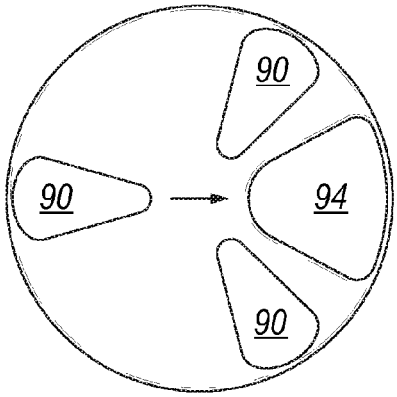
Figure 6C:
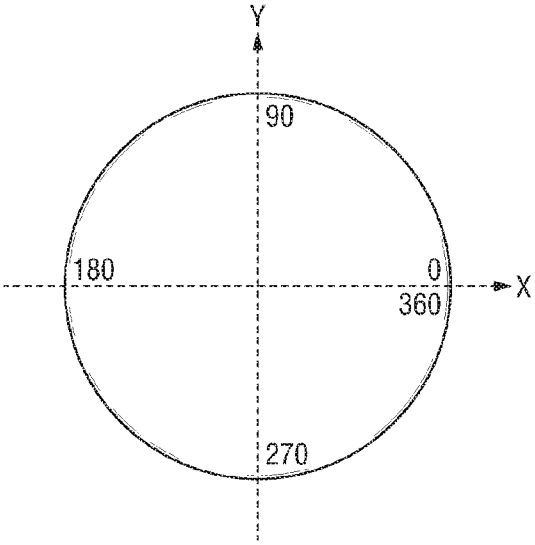
Figure 7:
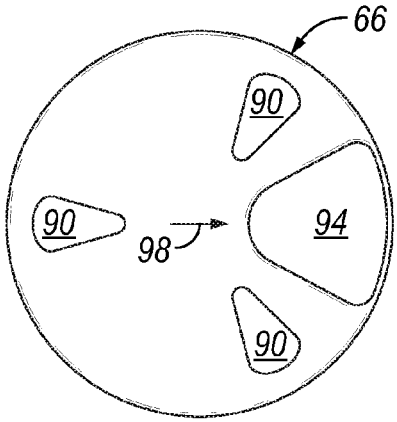
FIG. 7 is a schematic illustration of an alternate embodiment of the rotational valve, according to an embodiment of the present invention.
Figure 8A:
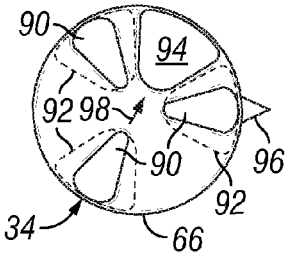
FIG. 8 is a schematic illustration of the corresponding positions of the rotational valve openings and the corresponding flow ports during operation of the rotary steerable system when no side force is generated, according to an embodiment of the present invention.
Figure 8B:
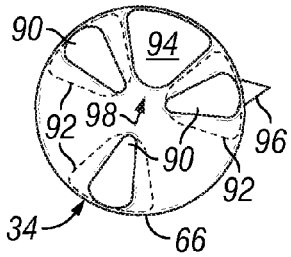
Figure 8C:
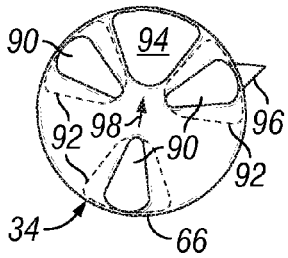
Figure 8D:
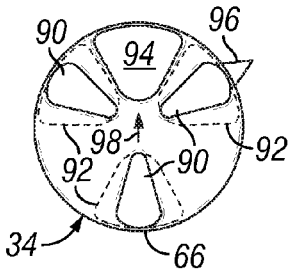
Figure 8E:
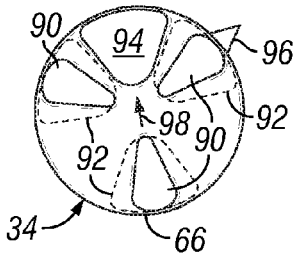
Figure 8F:
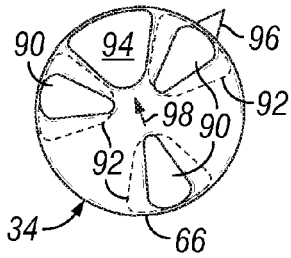
Figure 8G:
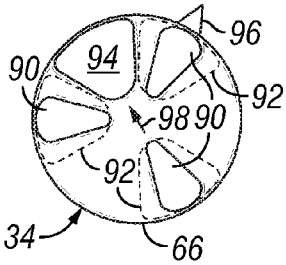
Figure 8H:
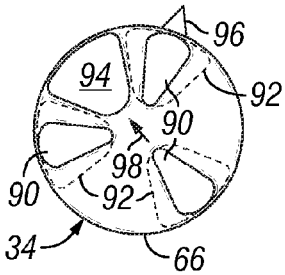
Figure 8I:
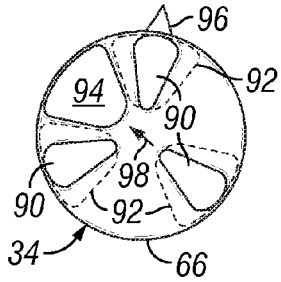
Figure 8J:
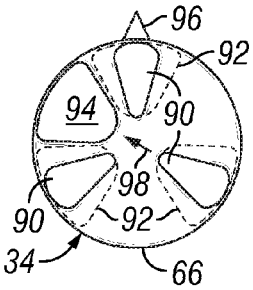
Figure 8K:
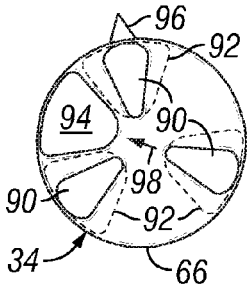
Figure 8L:
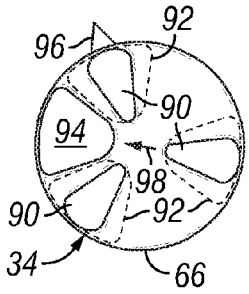
Figure 8M:
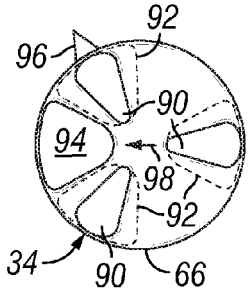

When the spider valve 66 is positioned as illustrated in FIG. 4, the spider valve has the larger valve opening 94 located at 0° and the three smaller valve openings 90 located at 60°, 180°, and 300°, as illustrated schematically in FIG. 6. The first (1), second (2), and third (3) ports 92 of the drill collar are positioned at 0°, 120°, and 240°, as further illustrated in FIG. 6. The size of the various valve openings and ports may vary according to a variety of design parameters. In one example, however, the larger valve opening 94 has an angular width of 56° while the three smaller valve openings 90 have angular widths of 30°. However, the angular widths and radial lengths of the openings 90, 94 and ports 92 may be changed for different applications. In FIG. 7, for example, an alternate embodiment of spider valve 66 is illustrated in which valve openings 90 have shorter radial lengths and smaller angular widths of, for example, 20°. The valve openings and ports can be sized as desired for a given application. For example, valve openings 90 may be sized to provide sufficient pressure to activate the steering pads 30. In some applications, the valve openings are sized to provide a reduced force on the steering pads 30 by creating a pressure drop across the spider valve 66.

Referring generally to FIG. 8, a schematic sequence of spider valve positions relative to the ports 92 of the rotating drill collar 34 is illustrated to show how spider valve 66 may be employed to actuate steering pads 30 without producing any side force. In this example, arrow marker 98 indicates the rotational angle of the spider valve 66, and triangular marker 96 indicates the angular position of the drill collar 34. If the spider valve 66 allows actuating fluid pressure, e.g. drilling mud pressure, to be applied to the steering pad 30, the corresponding port 92 is illustrated as shaded. However if the port 92 is not shaded, actuating fluid pressure is not supplied to the corresponding steering pad 30, leaving the pad collapsed. If the port 92 is indicated in dashed lines, the port is hidden below the spider valve 66 and closed to flow of actuating fluid. In these examples, the drill collar 34 rotates in a counterclockwise direction.

As illustrated in FIG. 8, electric motor 72 is controlled by controller 76 to rotate spider valve 66 in a manner which allows the rotary steerable system 28 to drill without generating a side force. FIG. 8 illustrates the angular position of drill collar 34 increasing from 0° to 120° in 10° increments. The spider valve 66 is controlled to maintain a relative angle of 60° with respect to the drill collar 34 so that the larger valve opening 94 remains positioned between the first (1) and third (3) ports 92 while the three smaller valve openings 90 are maintained in alignment with first (1), second (2), and third (3) ports 92 to direct flow of actuating fluid through the ports. Consequently, all three ports 92 are open and all three steering pads 30 are activated via flow of drilling/actuating fluid through the hydraulic lines 68. It should be noted the spider valve 26 may be positioned at three different angular positions to enable simultaneous flow through the three ports 92 and activation of all steering pads 30.

Figure 9:
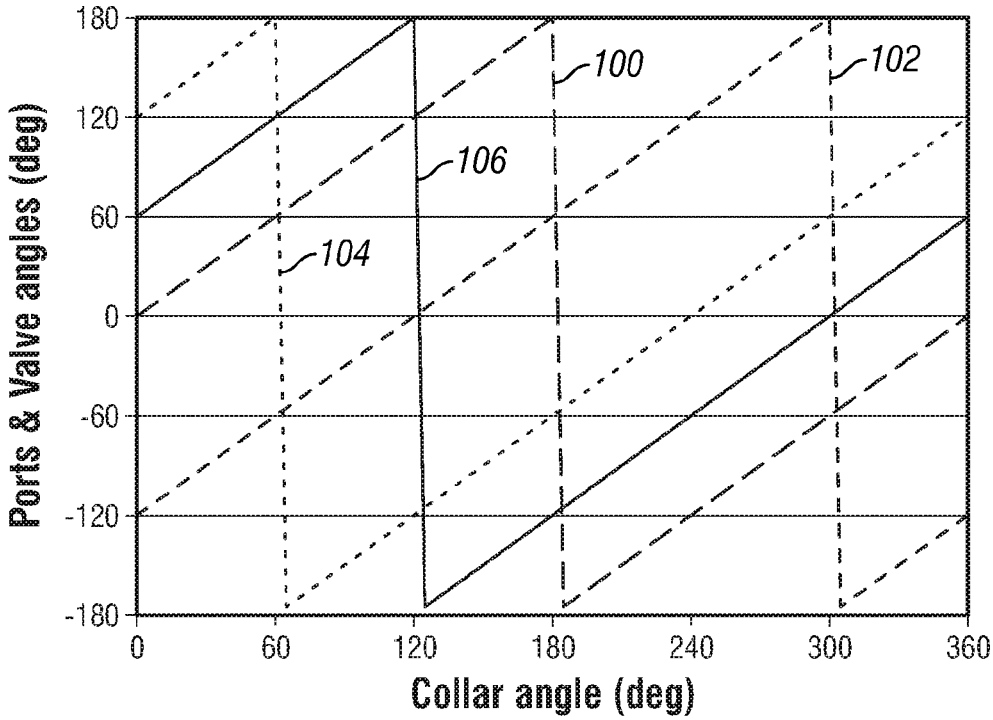
FIG. 9 is a graphical representation showing the drill collar angle versus the angular position of the rotational valve openings and the flow ports, according to an embodiment of the present invention.
Figure 10A:
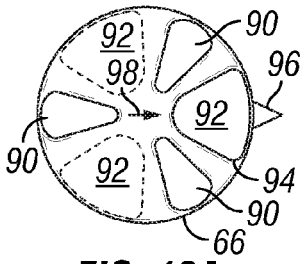
FIG. 10 is a schematic illustration of the corresponding positions of the rotational valve openings and the corresponding flow ports during operation of the rotary steerable system when side force is generated between the −50° and +50° angular positions of the drill collar, according to an embodiment of the present invention.
Figure 10B:
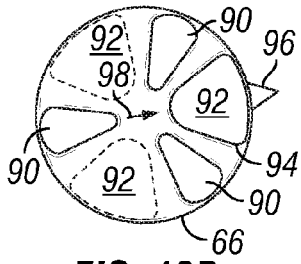
Figure 10C:
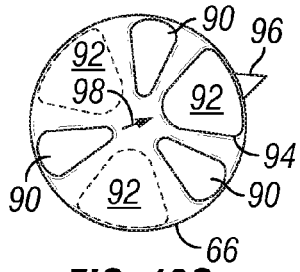
Figure 10D:
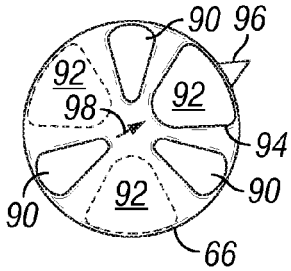
Figure 10E:
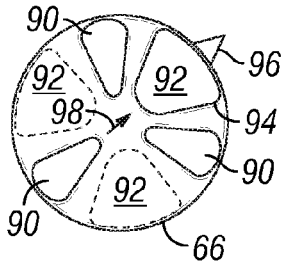
Figure 10F:
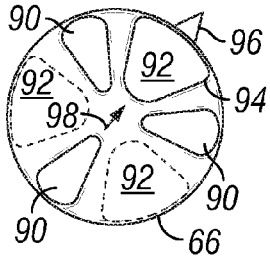
Figure 10G:
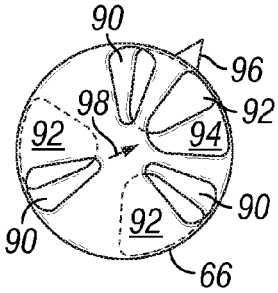
Figure 10H:
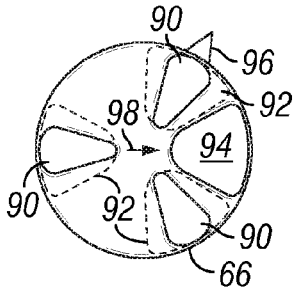
Figure 10I:
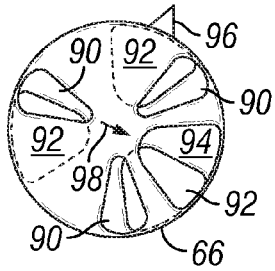
Figure 10J:
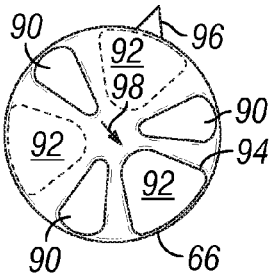
Figure 10K:
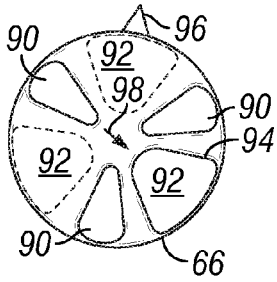
Figure 10L:
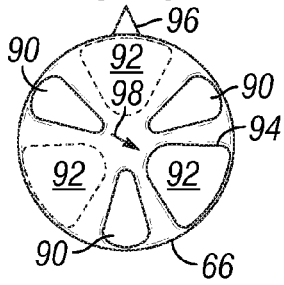
Figure 10M:
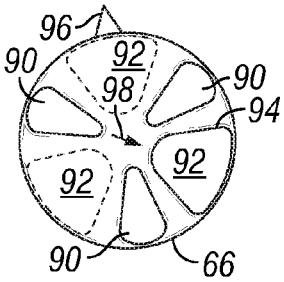
Figure 10N:
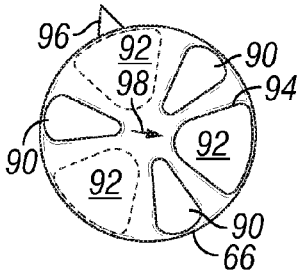
Figure 10O:
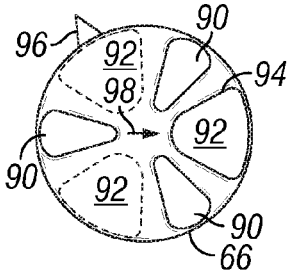

To maintain the larger valve opening 94 in an off position, the relative angular position of the spider valve 66 is continuously measured using sensor/encoder 74. The angular position of the drill collar 34 is known due to the rigid mounting of the pressure housing 86 to the drill collar. In the graphical illustration of FIG. 9, a plot is provided of the angular positions of the first (1), second (2) and third (3) ports 92 as represented by graph lines 100, 102 and 104, respectively. The angular position of ports 92 are plotted against the angular position of the spider valve 66, e.g. versus the angular position of large valve opening 94, as represented by graph line 106 for a full rotation of the drill collar 34. In this application, the spider valve 66 rotates at the same RPM as the drill collar 34, and the large valve opening 94 remains between the first (1) and the third (3) ports 92 during the full 360° of rotation.

If a side force is to be applied to the rotary steerable system 28, the spider valve 66 is controlled via motor 72 and controller 76 to open a port 92 in a manner which allows activating fluid 50 to activate a corresponding steering pad 30 while the other two ports 92 are closed. In the example illustrated in FIG. 10, the side force is applied primarily in a positive x-direction to deflect the rotary steerable system 28 toward the negative x-direction. FIG. 10 illustrates a sequence of drill collar 34 and spider valve 66 rotational movements that produce a relatively large side force. In this illustration, the angular positions of the drill collar 34 range from 0° to 120° while the angular positions of the spider valve 66 range between −50° and +50°.

As illustrated, the spider valve angle is the same as the drill collar angle from 0° to 50°. During this portion of rotation, the large valve opening 94 is maintained in alignment with the first (1) port 92 to enable flow to the corresponding steering pad 30. Once the 50° angular position is reached, the spider valve 66 is rotated rapidly in the clockwise direction so the first (1) port 92 is closed and the second (2) port 92 is opened to pressurized actuating fluid. As the drill collar 34 continues to rotate from 60° to 120°, the spider valve 66 is rotated from −50° to 0°. During rotation of the spider valve 66 from −50° to 0°, the large valve opening 94 is maintained in alignment with the second (2) port 92 to enable flow to the corresponding steering pad 30. When, for example, the drill collar angle is between 55° and 65°, all ports 92 are partially open which temporarily activates all steering pads 30 so no net side force is generated during this portion of rotation. However, side forces are delivered during rotation of the drill collar 34 between angular positions from −50° to +50°. A similar sequence of relative spider valve movement occurs for the second (2) port 92 for drill collar angles from 120° to 240° and for the third (3) port 92 for drill collar angles from 240° to 360°.

Figure 11:
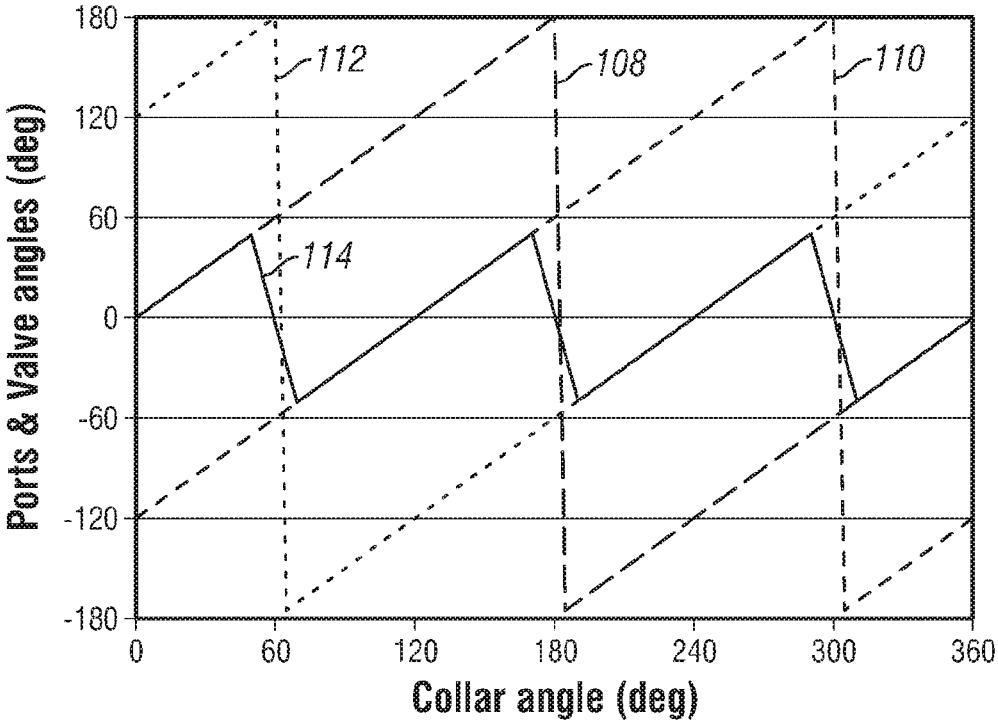
FIG. 11 is a graphical representation showing the drill collar angle versus the angular position of the rotational valve openings and the flow ports during production of side forces from −50° to +50°, according to an embodiment of the present invention.

In FIG. 11, the collar angle as represented by triangular marker 96 is plotted versus the angular position of first (1), second (2), and third (3) ports 92 (see graph lines 108, 110 and 112, respectively) and the angular position of the spider valve 66 based on arrow marker 98 (see graph line 114). The sequence depicted in FIGS. 10 and 11 represents rotation of the spider valve 66 over an angular range of 100° (from +50° to −50°) while the drill collar 34 rotates 20° (from +50° to +70°). Accordingly, the spider valve 66 is able to rotate at five times the RPM of the drill collar 34 based on input from motor 72. By way of example, if the maximum RPM of the drill string 24 and thus of the drill collar 34 is 180 RPM, motor 72 is selected with a capability of rotating the spider valve at 900 RPM or 15 Hz. However, these rotational speeds are merely examples and the actual rotational speeds of the drill string, drill collar and spider valve may be selected according to the parameters of a specific application.

When only one port 92 is open at any instant, the forces on the bottom hole assembly/rotary steerable system can be calculated from the angle of the drill collar 34. If all three ports 92 are open, then there is no net side force. The forces acting on the rotary steerable system in the x and y directions are given by $Fx=-F\cos(\theta)$ and $Fx=-F\sin(\theta)$ where $\theta$ is the angle of the drill collar modulo 120° and where F is the force the steering pad 30 exerts against the borehole wall. The force F is equal to the area of the hydraulic piston 64 times the differential pressure ($\Delta P$) between the piston chamber of the steering pad 30 and the borehole pressure. Provided the valve openings and the port openings are sufficiently large, the differential pressure is equal to the pressure drop between the inside and outside of the drill collar 34.

In some applications in which straight sections of wellbore 26 are drilled, the three smaller valve openings 90 of spider valve 66 may be formed with a reduced size to create a pressure drop across the spider valve 66. The pressure drop reduces the forces acting on the three steering pads 30 compared to the force applied when only one steering pad 30 is activated. The use of a pressure drop enables stabilization of the drill bit 36 without adding significantly to wear on the steering pads 30.

Figure 12:
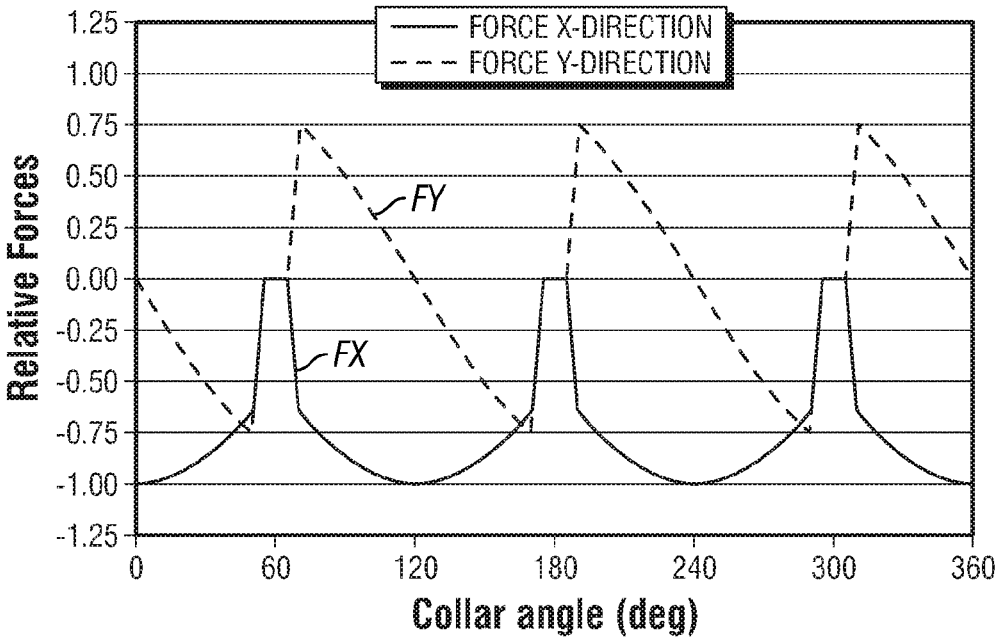
FIG. 12 is a graphical representation showing the drill collar angle versus the relative forces generated in the X and Y directions, according to an embodiment of the present invention.
Figure 13A:
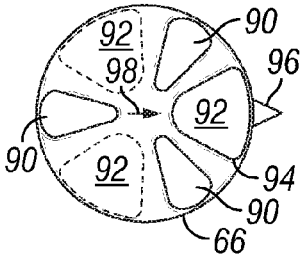
FIG. 13 is a schematic illustration of the corresponding positions of the rotational valve openings and the corresponding flow ports during operation of the rotary steerable system when side force is generated between the −30° and +30° angular positions, according to an embodiment of the present invention.
Figure 13B:
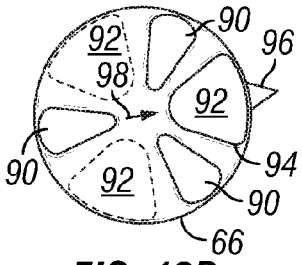
Figure 13C:
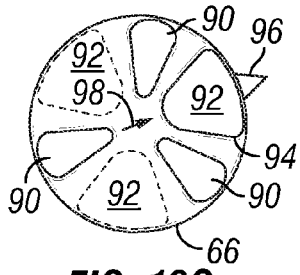
Figure 13D:
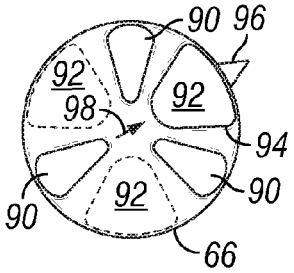
Figure 13E:
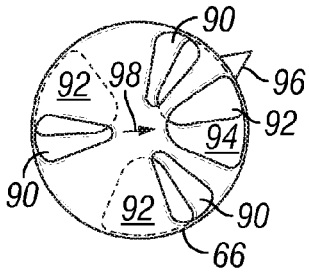
Figure 13F:
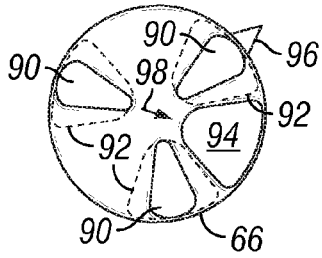
Figure 13G:
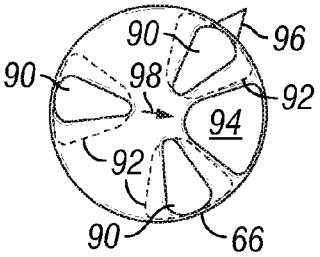
Figure 13H:
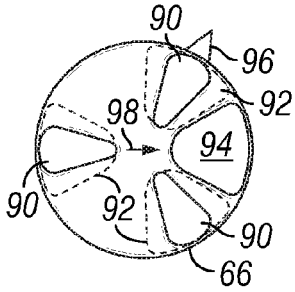
Figure 13I:
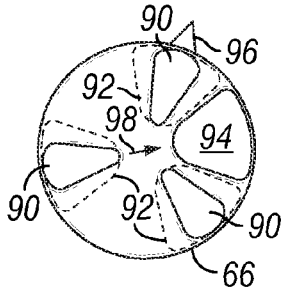
Figure 13J:
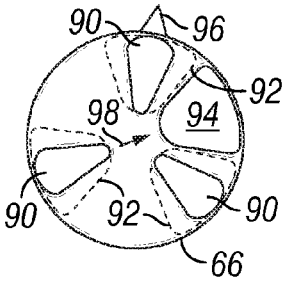
Figure 13K:
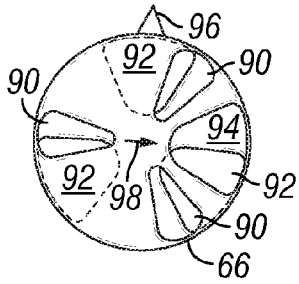
Figure 13L:
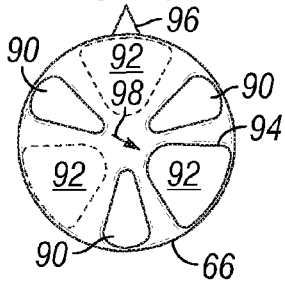
Figure 13M:
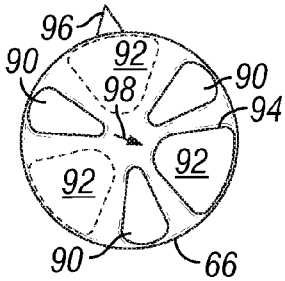
Figure 13N:
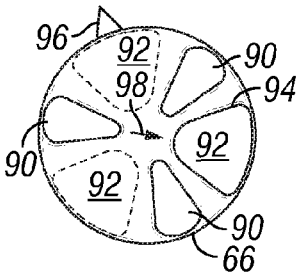
Figure 13O:
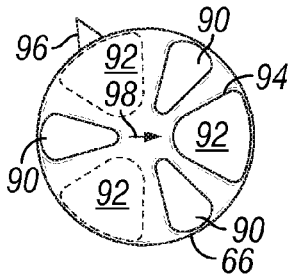

The x and y components of the force are plotted versus the angular position of the drill collar 34 in the graph of FIG. 12. The force in the x-direction is never positive ($Fx\leq 0$) while the force in the y-direction is equally applied in the positive and negative directions. As illustrated, large excursions occur in the Fy component but the average force in the y-direction is zero. The drill bit deflection is proportional to the force component average over a revolution of the drill collar:

$$\langle Fx\rangle = \frac{1}{2\pi}\int_0^{2\pi} Fx(\theta)\,d\theta \text{ and}$$

$$\langle Fy\rangle = \frac{1}{2\pi}\int_0^{2\pi} Fy(\theta)\,d\theta.$$

As noted above, $\langle Fy\rangle$ equals zero and therefore no net deflection occurs in the y-direction.

To reduce the dogleg severity during drilling of wellbore 26, the spider valve 26 may be controlled to alternate between the two drilling modes described above. For example, all steering pads 30 may be activated during one rotation of drill collar 34 as illustrated in FIG. 8. However, the selective activation of single steering pads 30 may be employed to drill at an angle (dogleg) during the next rotation of drill collar 34 as illustrated in FIG. 10. By varying the number of rotations for the two modes, a range of doglegs or drilling angles can be achieved from a deviation angle of zero to a maximum possible deviation angle.

Another method which may be employed to control the dogleg severity is to selectively activate steering pads 30 during a single rotation of the drill collar 34. For example, the spider valve 66 may be operated to align the large valve opening 94 with the first (1) port 92 to activate the corresponding first steering pad 30 for drill collar angles from 0° to 60°. The spider valve 66 may then be controlled to align the large valve opening 94 with the second (2) port 92 to activate the second steering pad 30 for drill collar angles from 60° to 120°. Subsequently, all three steering pads 30 may be simultaneously actuated for drill collar angles from 120° to 360° to limit the dogleg severity. Increased dogleg severity may be achieved by activating a single steering pad 30 to create side forces over the drill collar angles from, for example, 0° to 240° but not from 240° to 360°. Various methods for controlling dogleg severity, such as those described above, may be combined to alternate between drilling straight sections in which all three steering pads 30 are activated and drilling deviated sections in which steering pads 30 are individually activated.

Use of the electric motor 72 to control spider valve 66 also facilitates another method for varying the deflection force acting on the rotary steerable system 28. This latter method involves restricting the range of drill collar angles over which a single steering pad 30 is activated. For example, movement of the spider valve 66 may be programmed to create a side force applied to the rotary steerable system 28 by opening a port 92 over a restricted angular range while the other two ports 92 are closed. In the example illustrated in FIG. 13, the side force is applied primarily in a positive x-direction to deflect the rotary steerable system 28 toward the negative x-direction. FIG. 13 illustrates a sequence of drill collar 34 and spider valve 66 rotational movements which produce a smaller side force. In this example, the angular positions of the drill collar 34 range from 0° to 120° while the angular positions of the spider valve 66 range between −30° and +30°. The reduced period during which the force is applied in the x-direction results in a lower dogleg severity.

As illustrated, the spider valve angle is the same as the drill collar angle from 0° to 30°. During this portion of rotation, the large valve opening 94 is maintained in alignment with the first (1) port 92 to enable flow to the corresponding steering pad 30. Once the 30° angular position is reached, the spider valve 66 begins to rotate clockwise. When the drill collar angle reaches 40°, the spider valve angle is −20°. From 40° to 80°, the spider valve 66 rotates at the same RPM as the drill collar 34 and it lags the drill collar angle by 60°. Within this angular range, the three smaller valve openings 90 in the spider valve 66 are aligned with the three ports 92 and activate the corresponding steering pads 30. As a result, there is no net side force on the steerable assembly 28 for drill collar angles from approximately 35° to 85°. Subsequently, the second steering pad 30 is activated from 90° to 120° of drill collar rotation.

Figure 14:
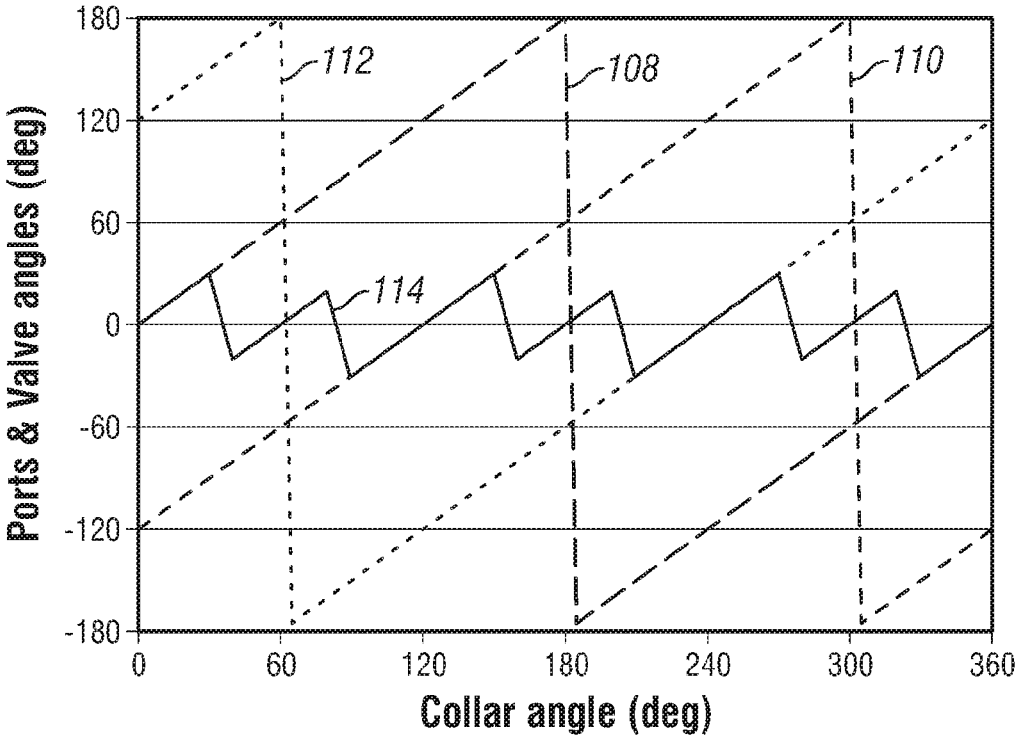
FIG. 14 is a graphical representation showing the drill collar angle versus the angular position of the rotational valve openings and the flow ports during production of side forces from −30° to +30°, according to an embodiment of the present invention.

In FIG. 14, the drill collar angle, as represented by triangular marker 96, is plotted versus the angular position of first (1), second (2), and third (3) ports 92 (see graph lines 108, 110 and 112, respectively) and versus the angular position of the spider valve 66 based on arrow marker 98 (see graph line 114). The sequence depicted in FIGS. 13 and 14 show that the spider valve 66 follows a sawtooth pattern. Except during transitions, the spider valve 66 is moving at the same RPM as the drill collar 34.

Figure 15:
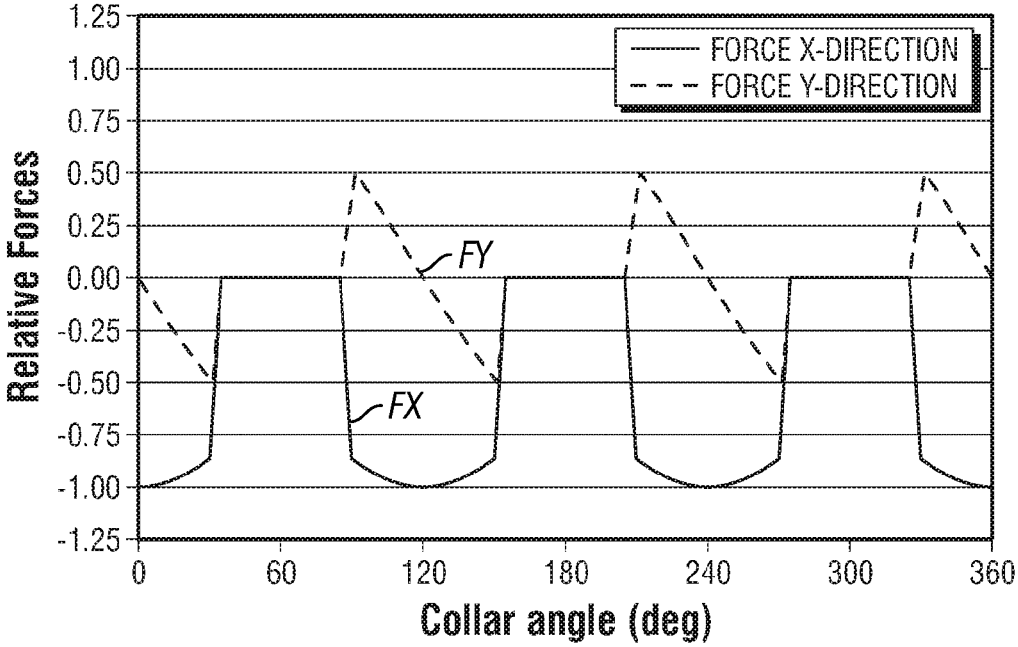
FIG. 15 is a graphical representation showing the drill collar angle versus the relative forces generated in the X and Y directions, according to an embodiment of the present invention.
Figure 16A:
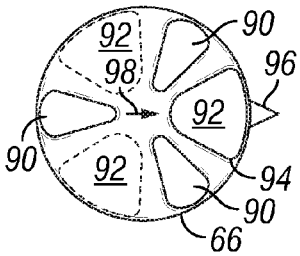
FIG. 16 is a schematic illustration of the corresponding positions of the rotational valve openings and the corresponding flow ports during operation of the rotary steerable system when side force is generated between the −10° and +10° angular positions, according to an embodiment of the present invention.
Figure 16B:
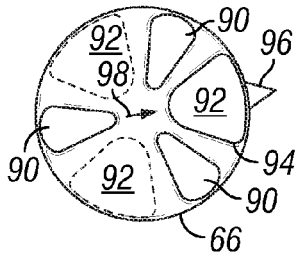
Figure 16C:
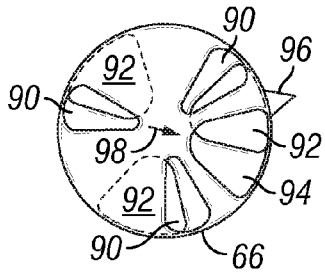
Figure 16D:
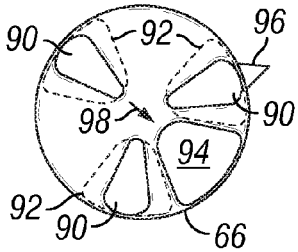
Figure 16E:
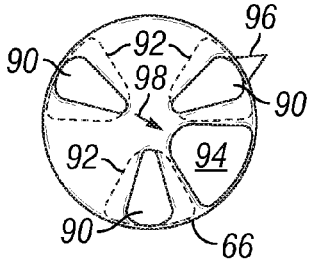
Figure 16F:
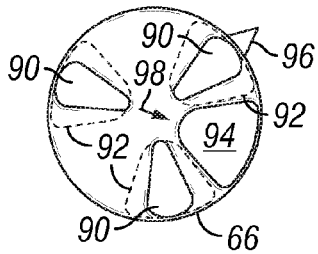
Figure 16G:
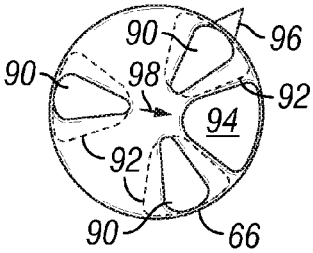
Figure 16H:
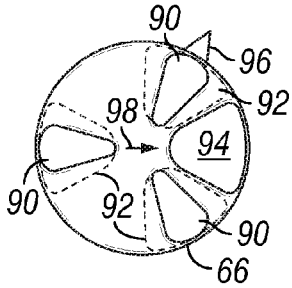
Figure 16I:
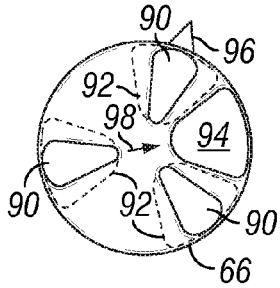
Figure 16J:
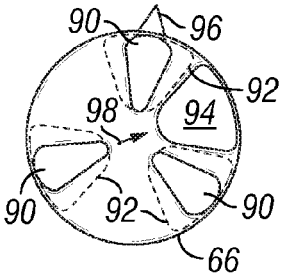
Figure 16K:
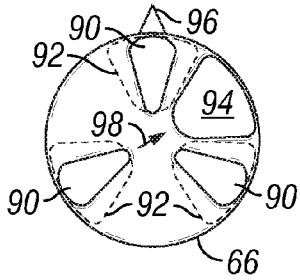
Figure 16L:
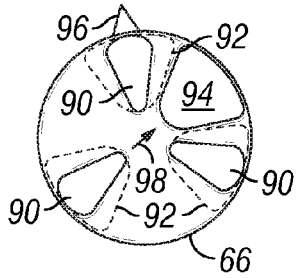
Figure 16M:
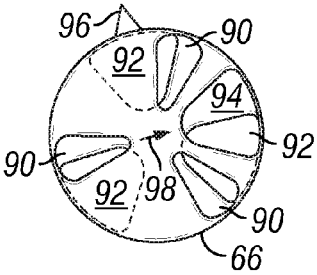
Figure 16N:
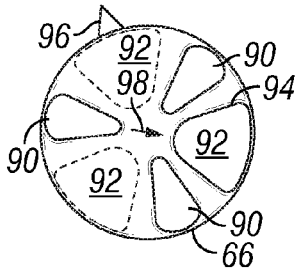
Figure 16O:
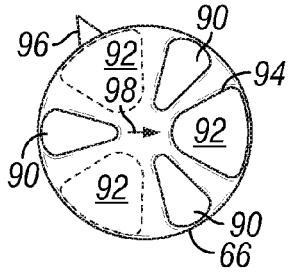

The force components in the x and y directions are illustrated in FIG. 15. As illustrated, three angular ranges occur in each drill collar rotation in which no forces are applied. In this example, no forces are applied from 35° to 85°, 155° to 205°, and 275° to 325° of drill collar rotation. The maximum force in the y-direction has been significantly reduced, and the force in the x-direction also is reduced, but by a smaller amount. Thus, the application of force is more efficient in deflecting the drill bit in the x-direction because less energy has been expended in the y-direction.

A still greater reduction in dogleg severity is achieved by controlling spider valve 66 according to the sequence of rotational positions illustrated in FIG. 16. This method further reduces the deflection force acting on the rotary steerable system 28 by further restricting the range of drill collar angles over which a single steering pad 30 is activated to cause a deviation in the drilling direction. The spider valve 66 is rotated in a manner which maintains the spider valve in an "off" position for prolonged periods. In this example, movement of the spider valve 66 is again programmed to create a side force applied to the rotary steerable system 28 by opening a port 92 over a restricted angular range while the other two ports 92 are closed. In the example illustrated in FIG. 16, the side force is applied primarily in a positive x-direction to deflect the rotary steerable system 28 toward the negative x-direction. FIG. 16 illustrates a sequence of drill collar 34 and spider valve 66 rotational movements that produce a smaller side force. In this example, the angular positions of the drill collar 34 range from 0° to 120° while the angular positions of the spider valve 66 range between −10° and +10°. The smaller angular range during which the force is applied in the x-direction results in a further reduced dogleg severity.

As illustrated, the spider valve angle is the same as the drill collar angle from 0° to 10°. During this portion of rotation, the large valve opening 94 is maintained in alignment with the first (1) port 92 to enable flow to the corresponding steering pad 30. Once the 10° angular position is reached, the spider valve 66 begins to rotate clockwise. When the drill collar angle reaches 15°, the spider valve angle is −15°. The spider valve 66 then rotates at the same RPM as the drill collar 34 while actuating fluid flows through the three small valve openings 90 and through corresponding ports 92, effectively transitioning the spider valve 66 to the "off" position in which no side force is generated. In this particular example, the spider valve is in this off position for prolonged periods in which the drill collar angle lies in the angular ranges from 15° to 105°, 135° to 225°, and 255° to 345°. One result is substantially less force applied in the y-direction. However, the force in the x-direction remains strong but is applied over a much more limited range of angular positions from −10° to +10°.

Figure 17:
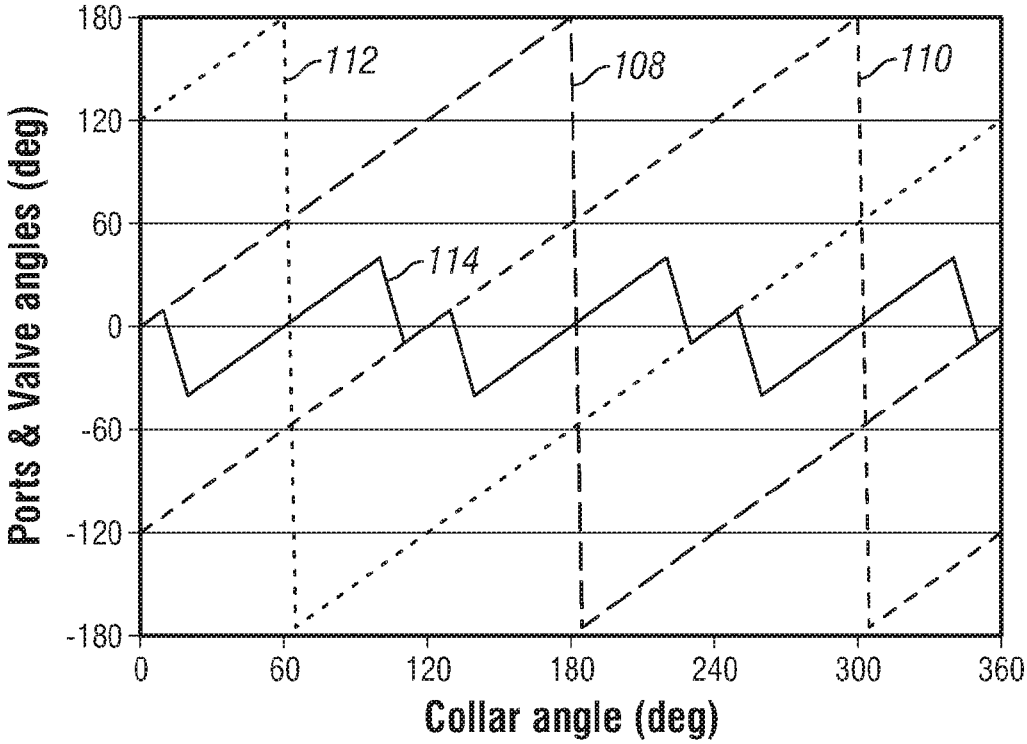
FIG. 17 is a graphical representation showing the drill collar angle versus the angular position of the rotational valve openings and the flow ports during production of side forces from −10° to +10°, according to an embodiment of the present invention.

In FIG. 17, the drill collar angle, as represented by triangular marker 96, is plotted versus the angular position of first (1), second (2), and third (3) ports 92 (see graph lines 108, 110 and 112, respectively) and versus the angular position of the spider valve 66 based on arrow marker 98 (see graph line 114). The sequence depicted in FIGS. 16 and 17 show that the spider valve 66 follows a pattern in which limited side forces are applied.

Figure 18:
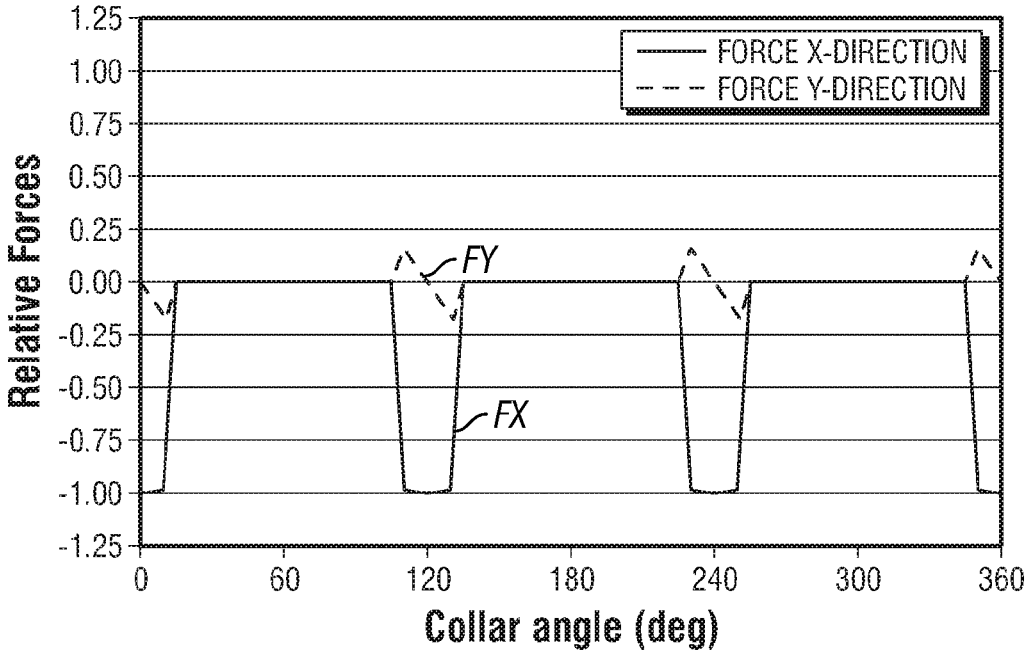
FIG. 18 is a graphical representation showing the drill collar angle versus the relative forces generated in the X and Y directions, according to an embodiment of the present invention.

The force components in the x and y directions are illustrated in FIG. 18. As illustrated, three substantial angular ranges occur in each drill collar rotation in which no forces are applied. In this example, no forces are applied from 15° to 105°, from 135° to 225°, and from 255° to 345°. As discussed above, the force in the y-direction is substantially reduced and the force in the x-direction is strong but applied over a very limited range.

Figure 19:
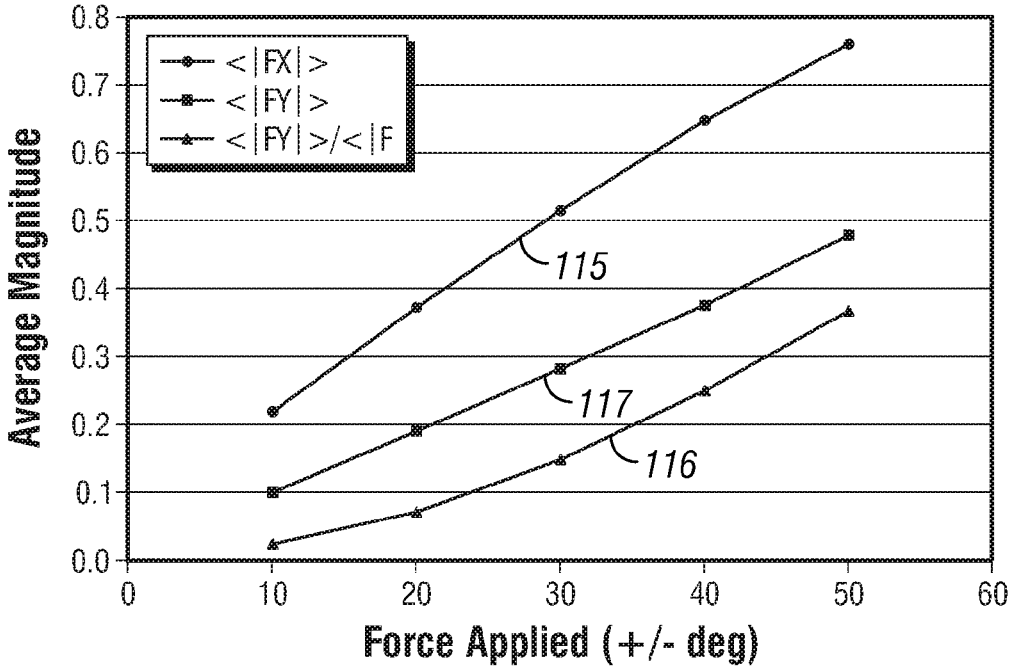
FIG. 19 is a graphical representation showing average forces applied versus activation angles, according to an embodiment of the present invention.

An example of the average forces applied versus the activation angles is illustrated in FIG. 19. The magnitude of the drill bit deflection in the x-direction is given by:

$$\langle Fx \rangle = \frac{1}{2\pi}\int_0^{2\pi} Fx(\theta)\,d\theta$$

because the sign of Fx is always negative. This quantity is plotted in FIG. 19 versus the range of angles over which the force is applied and labeled with graph line 115. The duration of the force Fx(θ) Is related to the angle of the spider valve 66. The maximum value for <|Fx|> is 0.76 for the range of angles from −50° to +50°, and the minimum value for <|Fx|> is 0.22 for the range of angles from −10° to +10° in the examples discussed above. It should be noted the radial force has a unity magnitude, i.e. F=1. The content illustrated graphically in FIG. 19 can be used in an algorithm to relate dogleg severity to the range of angles over which side forces are applied. This data can be used in a look-up table are simply calculated from a polynomial.

Even though there is no net impulse in the y-direction and the steering pads 30 do not exert forces in the positive or negative y directions, the steering pads may suffer wear and abrasion due to contact with the wellbore wall. The wear resulting from forces in the y-direction is proportional to:

$$\langle Fy \rangle = \frac{1}{2\pi}\int_0^{2\pi} Fy(\theta)\,d\theta$$

which is non-zero. Referring again to FIG. 19, both <|Fy|> and the ratio of <|Fy|>/<|Fx|> are plotted as graph lines 116 and 117, respectively. A small value for the ratio indicates a more efficient operation, i.e. less force is wasted in the y-direction which results in less steering pad wear.

Figure 20:
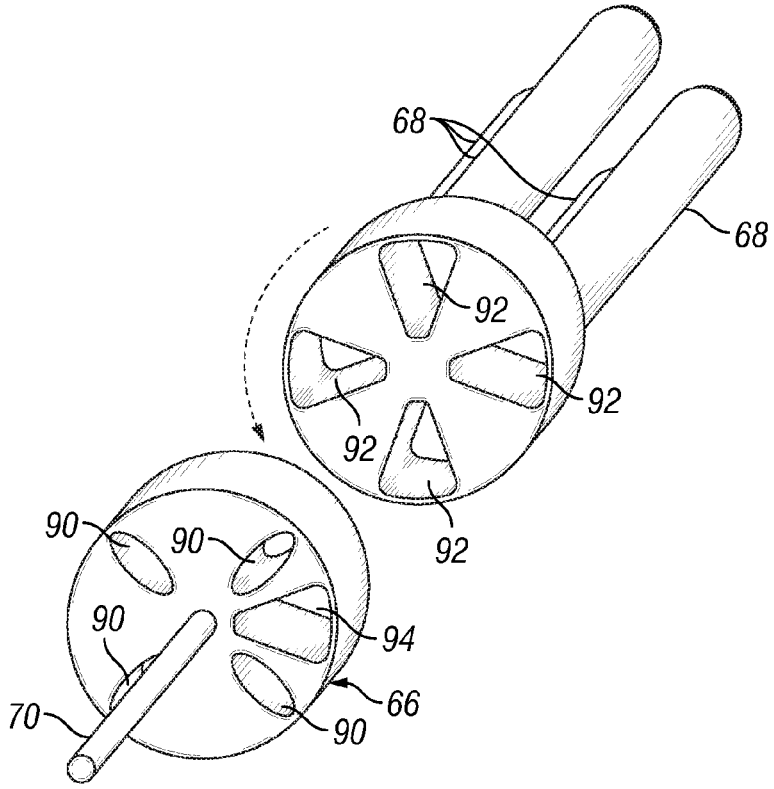
FIG. 20 is an exploded view of an alternate embodiment of the rotational valve/spider valve controlling flow of actuating fluid to a plurality of steering pads via corresponding flow ports, according to an embodiment of the present invention.

An alternate embodiment of spider valve 66 is illustrated in FIG. 20 in which an exploded view of spider valve 66 and corresponding drill collar ports 92 is illustrated. In this embodiment, the spider valve 66 comprises four valve openings 90 which are located at angular positions which correspond with four ports 92 of drill collar 34. The four ports 92 deliver actuating fluid 50 into hydraulic lines 68 which, in turn, deliver the actuating fluid to four corresponding steering pads 30. The spider valve 66 may be selectively rotated via shaft 70 and motor 72 to bring valve openings 90 into alignment or out of alignment with ports 92. To facilitate an understanding of the angular relationship of valve openings 90 with respect to ports 92, the ports 92 have been labeled as first (1), second (2), third (3), and fourth (4) ports. The first (1), second (2), third (3), and fourth (4) ports 92 correspond with first, second, third, and fourth movable steering pads 30. The spider valve 66 also comprises the additional, larger valve opening 94 which, in this embodiment, is a fifth opening. Valve opening 94 may be selectively aligned with desired ports 92 to control the directional drilling of deviated sections of wellbore 26.

Figure 21:
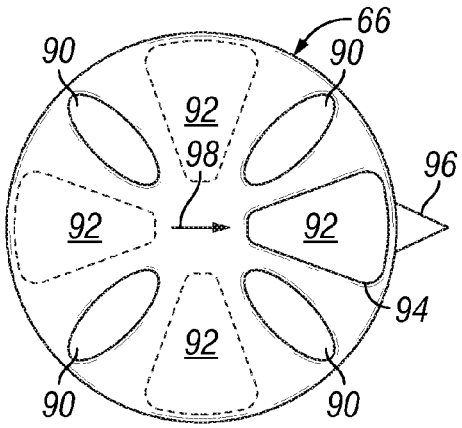
FIG. 21 is a schematic illustration of an operational position of the rotational valve with respect to the flow ports, according to an embodiment of the present invention.
Figure 22:
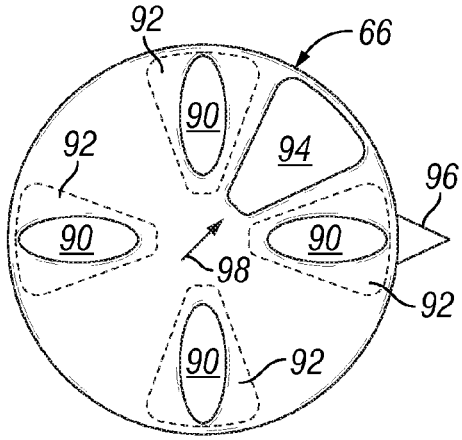
FIG. 22 is a schematic illustration of another operational position of the rotational valve with respect to the flow ports, according to an embodiment of the present invention.

In FIG. 21, a front view of the alternate spider valve 66 is illustrated at a selected angular orientation with respect to drill collar 34 and ports 92. The ports 92 behind spider valve 66, i.e. the ports closed by spider valve 66, are shown in dashed lines. In this example, the larger, additional valve opening 94 is aligned with the first (1) port 92 to allow flow of pressurized actuating fluid 50 to the first steering pad 30. Flow through valve openings 90 as well as second (2), third (3), and fourth (4) ports 92 is blocked. In FIG. 22, the relative angular position of spider valve 66 has been changed with respect to ports 92 so that the four smaller valve openings 90 are aligned with the four ports 92 to enable simultaneous flow to all four of the movable steering pads 30 via hydraulic lines 68.

Figure 23A:
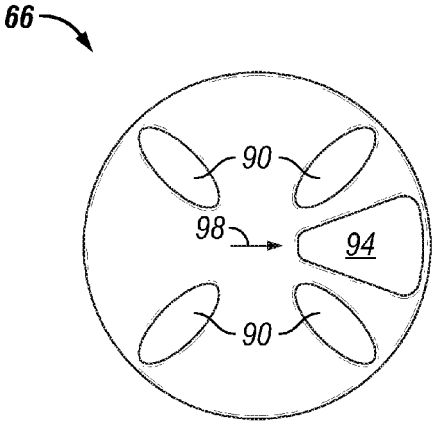
FIG. 23 is a schematic illustration showing the angular position of valve openings through the rotational valve and the angular position of flow ports of the example illustrated in FIG. 20, according to an embodiment of the present invention.
Figure 23B:
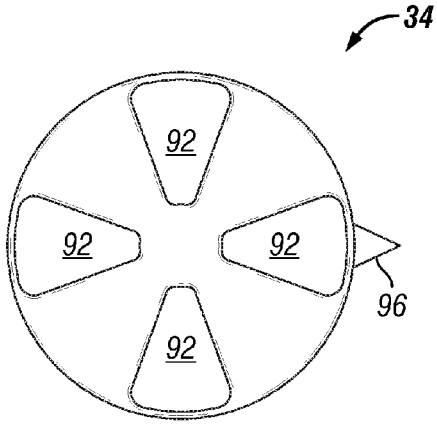
Figure 23C:
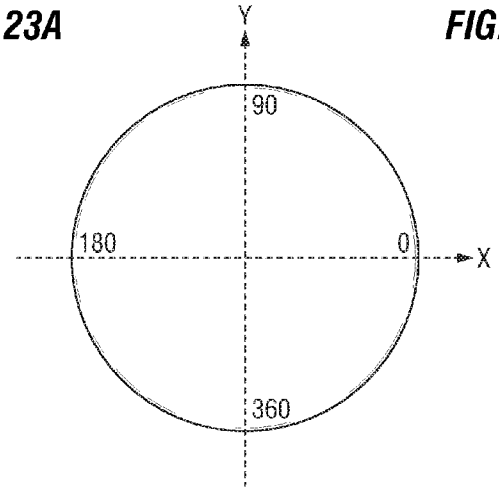
Figure 24A:
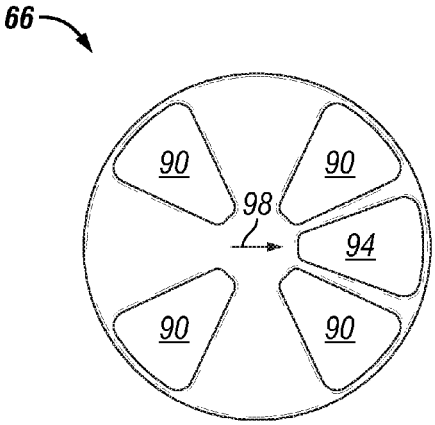
FIG. 24 is a schematic illustration of another example of the rotational valve, according to an embodiment of the present invention.
Figure 24B:
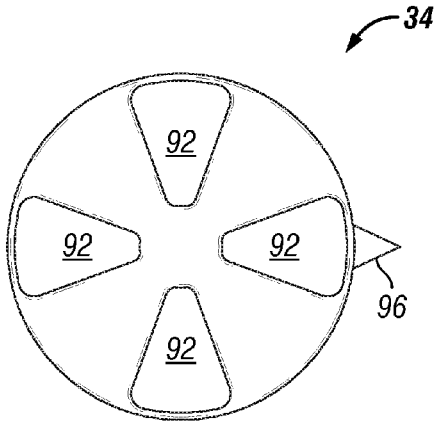
Figure 25A:
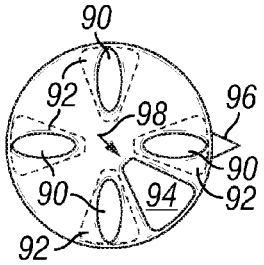
FIG. 25 is a schematic illustration of the corresponding positions of the rotational valve openings and the corresponding flow ports of the embodiment of FIG. 20 during operation of the rotary steerable system when no side force is generated, according to an embodiment of the present invention.
Figure 25B:
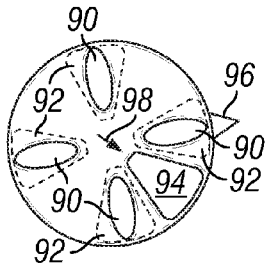
Figure 25C:
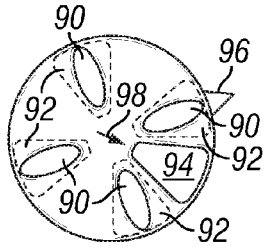
Figure 25D:
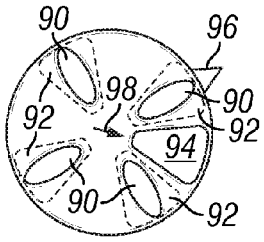
Figure 25E:
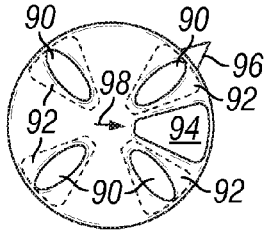
Figure 25F:
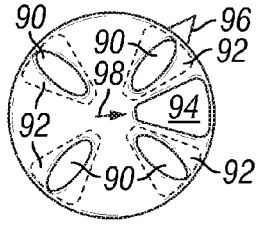
Figure 25G:
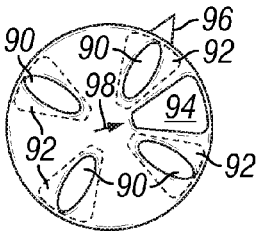
Figure 25H:
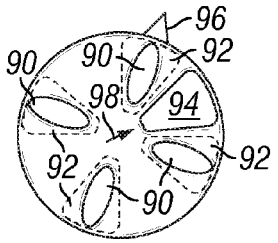
Figure 25I:
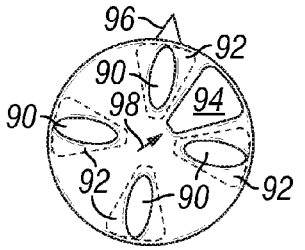
Figure 25J:
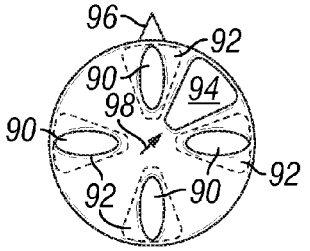

When the spider valve 66 is positioned as illustrated in FIG. 21, the spider valve has the valve opening 94 located at 0° and the four valve openings 90 located at 45°, 135°, 225° and 315°, as illustrated schematically in FIG. 23. The first (1), second (2), third (3), and fourth (4) ports 92 of the drill collar are positioned at 0°, 90°, 180° and 270°, as further illustrated in FIG. 23. The size of the various valve openings and ports may vary according to a variety of design parameters. In one example, however, the larger valve opening 94 has an angular width of 40° while the three smaller valve openings 90 have smaller angular widths. However, the angular widths and radial lengths of the openings 90, 94 and ports 92 may be changed for different applications. In FIG. 24, for example, an alternate embodiment of spider valve 66 is illustrated in which valve openings 90 are relatively large and have a width of, for example, 40°.

Referring generally to FIG. 25, a schematic sequence of spider valve positions relative to the ports 92 of the rotating drill collar 34 is illustrated to show how spider valve 66 may be employed to actuate steering pads 30 without producing any side force. In this example, arrow marker 98 indicates the rotational angle of the spider valve 66, and triangular marker 96 indicates the angular position of the drill collar 34. The spider valve 66 allows actuating fluid pressure, e.g. drilling mud pressure, to be applied to the steering pad 30 through a port 92 when the valve opening is shown over the port. If the port 92 is closed or not fully covered by a corresponding valve opening 90, the edges of the port are indicated in dashed lines. In these examples, the drill collar 34 rotates in a counterclockwise direction.

As illustrated in FIG. 25, electric motor 72 is controlled by controller 76 to rotate spider valve 66 in a manner which allows the rotary steerable system 28 to drill without generating a side force. FIG. 25 illustrates the angular position of drill collar 34 increasing from 0° to 90° in 10° increments. The spider valve 66 is controlled to maintain a relative angle of 45° with respect to the drill collar 34 so that the larger valve opening 94 remains positioned between the first (1) and second (2) ports 92 while the four smaller valve openings 90 are maintained in alignment with first (1), second (2), third (3), and fourth (4) ports 92, respectively, to direct flow of actuating fluid through the ports. Consequently, all four ports 92 are open and all four steering pads 30 are activated via flow of drilling/actuating fluid through the hydraulic lines 68. It should be noted the spider valve 66 may be positioned at four different angular positions to enable simultaneous flow through the three ports 92 and activation of the steering pads 30.

Figure 26:
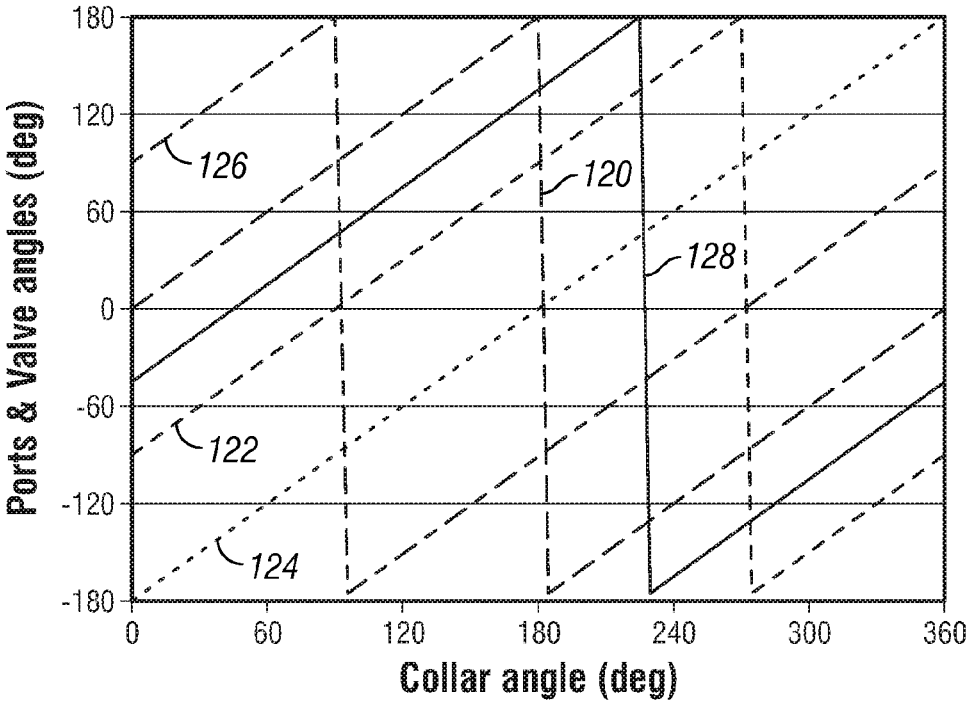
FIG. 26 is a graphical representation showing the drill collar angle versus the angular position of the rotational valve openings and the flow ports, according to an embodiment of the present invention.
Figure 27A:
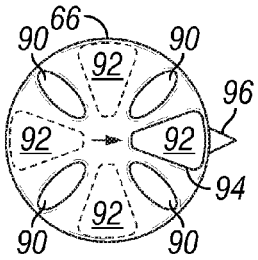
FIG. 27 is a schematic illustration of the corresponding positions of the rotational valve openings and the corresponding flow ports in the example of FIG. 20 during operation of the rotary steerable system when side force is generated between the −35° and +35° angular positions of the drill collar, according to an embodiment of the present invention.
Figure 27B:
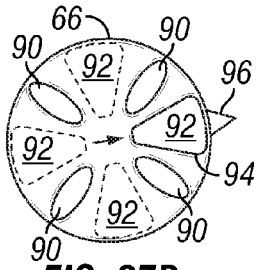
Figure 27C:
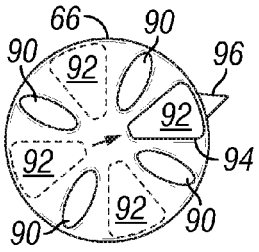
Figure 27D:
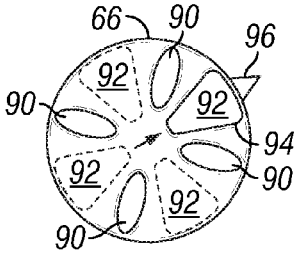
Figure 27E:
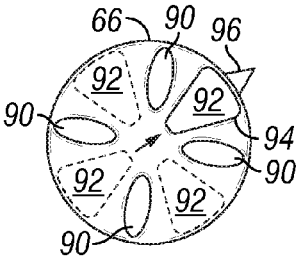
Figure 27F:
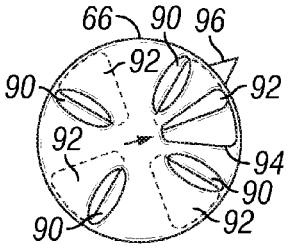
Figure 27G:
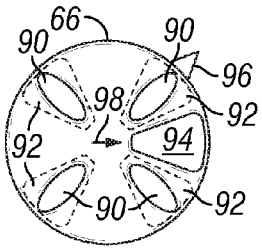
Figure 27H:
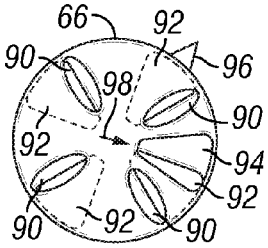
Figure 27I:
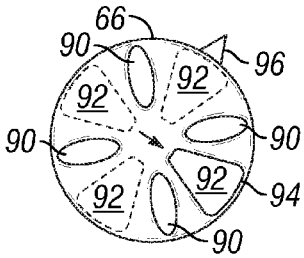
Figure 27J:
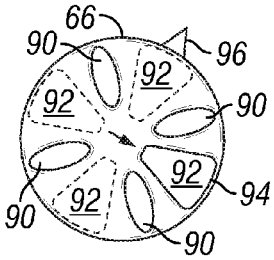
Figure 27K:
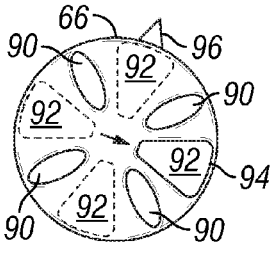
Figure 27L:
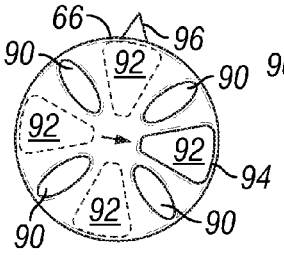
Figure 27M:
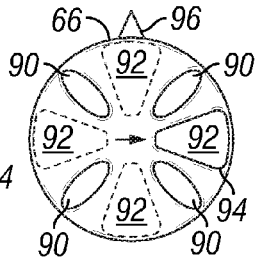

To maintain the larger valve opening 94 in an off position, the relative angular position of the spider valve 66 is continuously measured using sensor/encoder 74. The angular position of the drill collar 34 is known due to the rigid mounting of the pressure housing 86 to the drill collar. In the graphical illustration of FIG. 26, a plot is provided of the angular positions of the first (1), second (2), third (3), and fourth (4) ports 92 as represented by graph lines 120, 122, 124, and 126 respectively. The angular position of ports 92 are plotted against the angular position of the spider valve 66, e.g. versus the angular position of large valve opening 94, as represented by graph line 128 for a full rotation of the drill collar 34. In this application, the spider valve 66 rotates at the same RPM as the drill collar 34, and the large valve opening 94 remains between the first (1) and second (2) ports 92 during the full 360° of rotation.

If a side force is to be applied to the rotary steerable system 28, the spider valve 66 is controlled via motor 72 and controller 76 to open a port 92 in a manner which allows activating fluid 50 to activate a corresponding steering pad 30 while the other three ports 92 are closed. In the example illustrated in FIG. 27, the side force is applied primarily in a positive x-direction to deflect the rotary steerable system 28 toward the negative x-direction. FIG. 27 illustrates a sequence of drill collar 34 and spider valve 66 rotational movements that produce a relatively large side force. In this example, the angular positions of the drill collar 34 range from 0° to 90° while the angular positions of the spider valve 66 range between −35° and +35°.

As illustrated, the spider valve angle is the same as the drill collar angle from 0° to 35°. During this portion of rotation, the large valve opening 94 is maintained in alignment with the first (1) port 92 to enable flow to the corresponding steering pad 30. Once the 35° angular position is reached, the spider valve 66 is rotated rapidly in the clockwise direction so the first (1) port 92 is closed and the second (2) port 92 is opened to actuating fluid under pressure. As the drill collar 34 continues to rotate from 55° to 90°, the spider valve 66 is rotated from −35° to 0°. During rotation of the spider valve 66 from −35° to 0°, the large valve opening 94 is maintained in alignment with the second (2) port 92 to enable flow to the corresponding steering pad 30. When, for example, the drill collar angle is between 35° and 55°, all ports 92 are partially open which temporarily activates all steering pads 30 so no net side force is generated during this portion of rotation. However, side forces are generated during rotation of the drill collar 34 between angular positions from −35° to +35°. A similar sequence of relative spider valve movement occurs for the second (2) port 92 for drill collar angles from 90° to 180°, for the third (3) port 92 for drill collar angles from 180° to 270°, and for the fourth (4) port 92 for drill collar angles from 270° to 360°.

Figure 28:
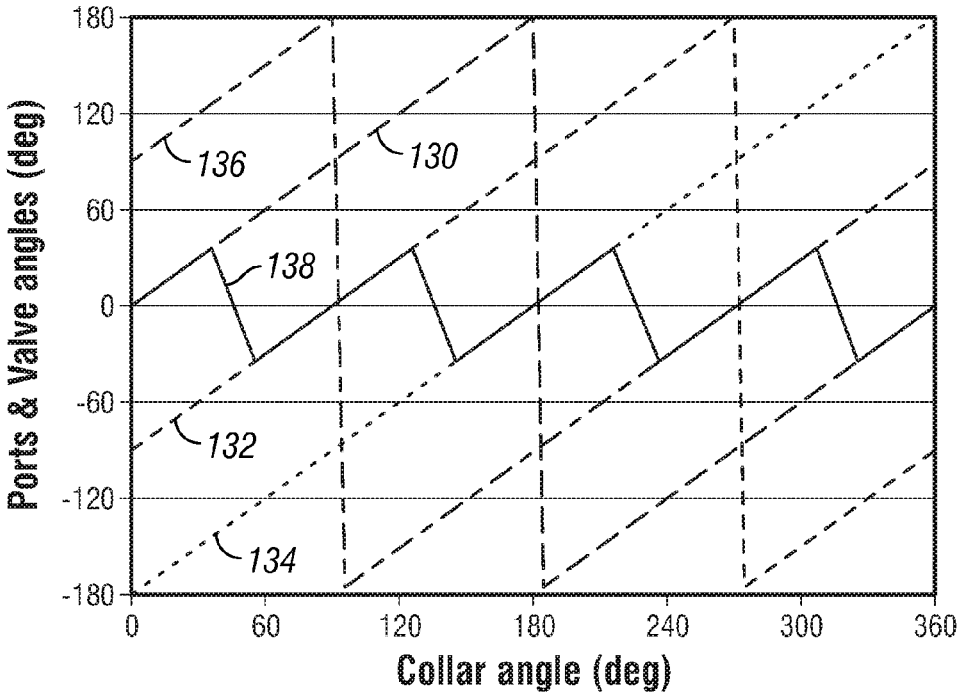
FIG. 28 is a graphical representation showing the drill collar angle versus the angular position of the rotational valve openings and the flow ports during production of side forces from −35° to +35°, according to an embodiment of the present invention.

In FIG. 28, the drill collar angle as represented by triangular marker 96 is plotted versus the angular position of first (1), second (2), third (3), and fourth (4) ports 92 (see graph lines 130, 132, 134, and 136, respectively) and versus the angular position of the spider valve 66 (see graph line 138). The sequence depicted in FIGS. 27 and 28 represents rotation of the spider valve 66 over an angular range of 70° (from +35° to −35°) while the drill collar 34 rotates 20° (from +35° to)+55°. Accordingly, the spider valve 66 is able to rotate at 3.5 times the RPM of the drill collar 34 based on input from motor 72. By way of example, if the maximum RPM of the drill string 24 and thus of the drill collar 34 is 180 RPM, motor 72 is selected with a capability of rotating the spider valve at 630 RPM or 10.5 Hz. However, these rotational speeds are merely examples and the actual rotational speeds of the drill string, drill collar and spider valve may be selected according to the parameters of a specific application.

In some applications in which straight sections of wellbore 26 are drilled, the four smaller valve openings 90 of spider valve 66 may be formed with a reduced size to create a pressure drop across the spider valve 66. The pressure drop reduces the forces acting on the four steering pads 30 compared to the force applied when only one steering pad 30 is activated. The use of a pressure drop enables stabilization of the drill bit 36 without adding significantly to wear on the steering pads 30.

Figure 29:
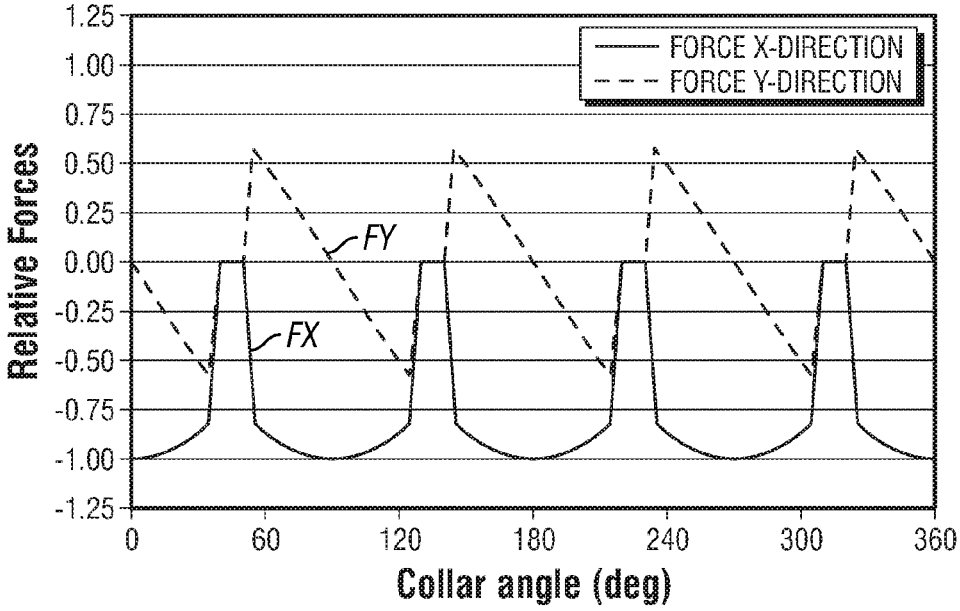
FIG. 29 is a graphical representation showing the drill collar angle versus the relative forces generated in the X and Y directions, according to an embodiment of the present invention.
Figure 30A:
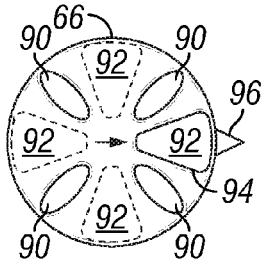
FIG. 30 is a schematic illustration of the corresponding positions of the rotational valve openings and the corresponding flow ports in the example of FIG. 20 during operation of the rotary steerable system when side force is generated between the −20° and +20° angular positions, according to an embodiment of the present invention.
Figure 30B:
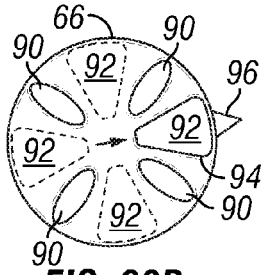
Figure 30C:
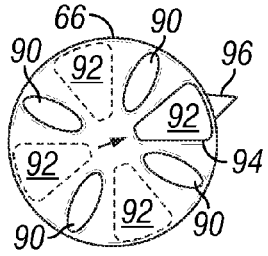
Figure 30D:
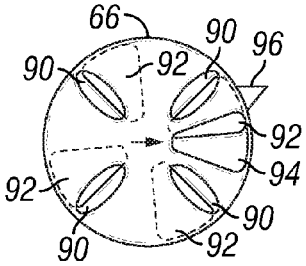
Figure 30E:
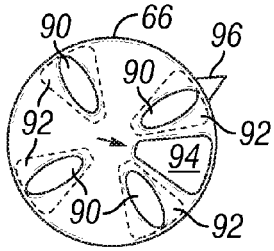
Figure 30F:
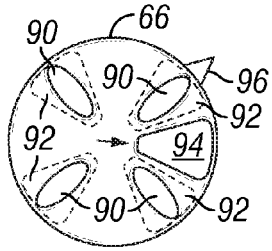
Figure 30G:
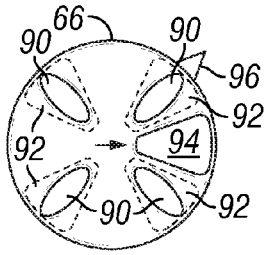
Figure 30H:
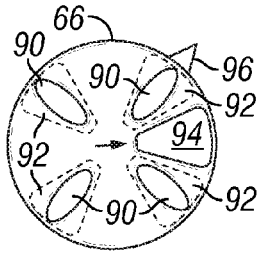
Figure 30I:
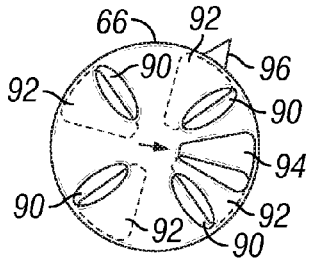
Figure 30J:
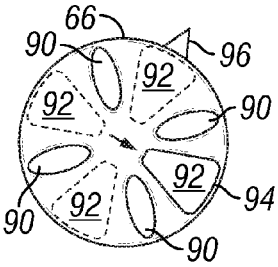
Figure 30K:
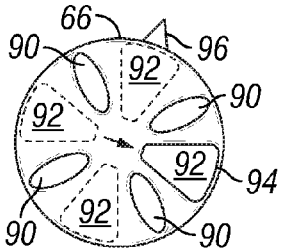
Figure 30L:
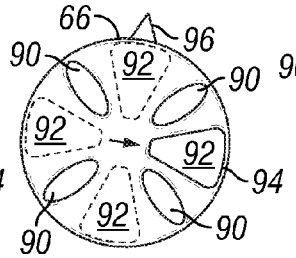
Figure 30M:
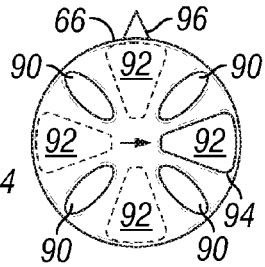

The x and y components of the force are plotted versus the angular position of the drill collar 34 in the graph of FIG. 29. The force in the x-direction is never positive ($Fx \leq 0$) while the force in the y-direction is equally applied in the positive and negative directions. As illustrated, large excursions occur in the Fy component but the average force in the y-direction is zero. As discussed above, the drill bit deflection is proportional to the force component average over a rotation of the drill collar:

$$\langle Fx \rangle = \frac{1}{2\pi}\int_0^{2\pi} Fx(\theta)\,d\theta \text{ and}$$

$$\langle Fy \rangle = \frac{1}{2\pi}\int_0^{2\pi} Fy(\theta)\,d\theta.$$

As noted above, <Fy> equals zero and therefore no net deflection occurs in the y-direction.

To reduce the dogleg severity during drilling wellbore 26, the spider valve 26 may be controlled to alternate between drilling modes such as those described above. For example, all steering pads 30 may be activated during one rotation of drill collar 34 as illustrated in FIG. 25. However, the selective activation of single steering pads 30 may be employed to drill at an angle (dogleg) as illustrated in FIG. 27 during the next rotation of drill collar 34. By varying the number of rotations for the two modes, a range of doglegs or drilling angles can be achieved from a deviation angle of zero to a maximum possible deviation angle.

Another method for controlling the dogleg severity is to selectively activate pistons during a single rotation of the drill collar 34. For example, the second steering pad 30 may be activated for drill collar angles from 55° to 145° to create a side force while the other three steering pads 30 are off. For the remainder of the drill collar rotation, i.e. from 145° to 55°, all four steering pads 30 may be simultaneously activated so no deflection occurs. Consequently, deflection occurs during only one quarter of the rotation. Additionally, this approach can be extended to activation of two steering pads so that deflection occurs during one half of the drill collar rotation, or to activation of three steering pads so that deflection occurs during three quarters of the drill collar rotation. Furthermore, this method may be combined with other methods to achieve the desired dogleg severity. For example, a combination of activating all steering pads 30 during drill collar rotations can be combined with activating a subset of the steering pads 30 during other drill collar rotations. A large number of steering possibilities are enabled by combining these two methods, and some of those possibilities are as follows:

| Rotations | Piston 1 | Piston 2 | Piston 3 | Piston 4 | rel. deflection |
|---|---|---|---|---|---|
| every | On | On | On | On | 1.00 |
| every | On | On | On | Off | 0.75 |
| every | On | On | Off | Off | 0.50 |
| every | On | Off | Off | Off | 0.25 |
| 2 of 3 | On | On | On | On | 0.67 |
| 2 of 3 | On | On | On | Off | 0.50 |
| 2 of 3 | On | On | Off | Off | 0.33 |
| 2 of 3 | On | Off | Off | Off | 0.17 |
| 1 of 2 | On | On | On | On | 0.50 |
| 1 of 2 | On | On | On | Off | 0.38 |
| 1 of 2 | On | On | Off | Off | 0.25 |
| 1 of 2 | On | Off | Off | Off | 0.13 |

Use of the electric motor 72 to control spider valve 66 also facilitates another method for varying the deflection force acting on the rotary steerable system 28 and involves restricting the range of drill collar angles over which a single steering pad 30 is activated. For example, movement of the spider valve 66 may be programmed to create a side force applied to the rotary steerable system 28 by opening a port 92 over a restricted angular range while the other three ports 92 are closed. In the example illustrated in FIG. 30, the side force is applied primarily in a positive x-direction to deflect the rotary steerable system 28 toward the negative x-direction. FIG. 30 illustrates a sequence of drill collar 34 and spider valve 66 rotational movements that produce a smaller side force. In this example, the angular positions of the drill collar 34 range from 0° to 90° while the angular positions of the spider valve 66 range between −20° and +20°. The reduced period during which the force is applied in the x-direction results in a lower dogleg severity.

As illustrated, the spider valve angle is the same as the drill collar angle from 0° to 20°. During this portion of rotation, the large valve opening 94 is maintained in alignment with the first (1) port 92 to enable flow to the corresponding steering pad 30. Once the 20° angular position is reached, the spider valve 66 begins to rotate clockwise to an angle of −15° and switches the first port off while the drill collar 34 rotates counterclockwise to +30°. The spider valve 66 remains at an angle of −45° relative to the drill collar 34 until the drill collar reaches +50°. At this point, the spider valve 66 again rotates clockwise to an angle of −90° with respect to the drill collar 34. As a result, there is no net side force on the steerable assembly 28 for drill collar angles from approximately 20° to 60°.

Figure 31:
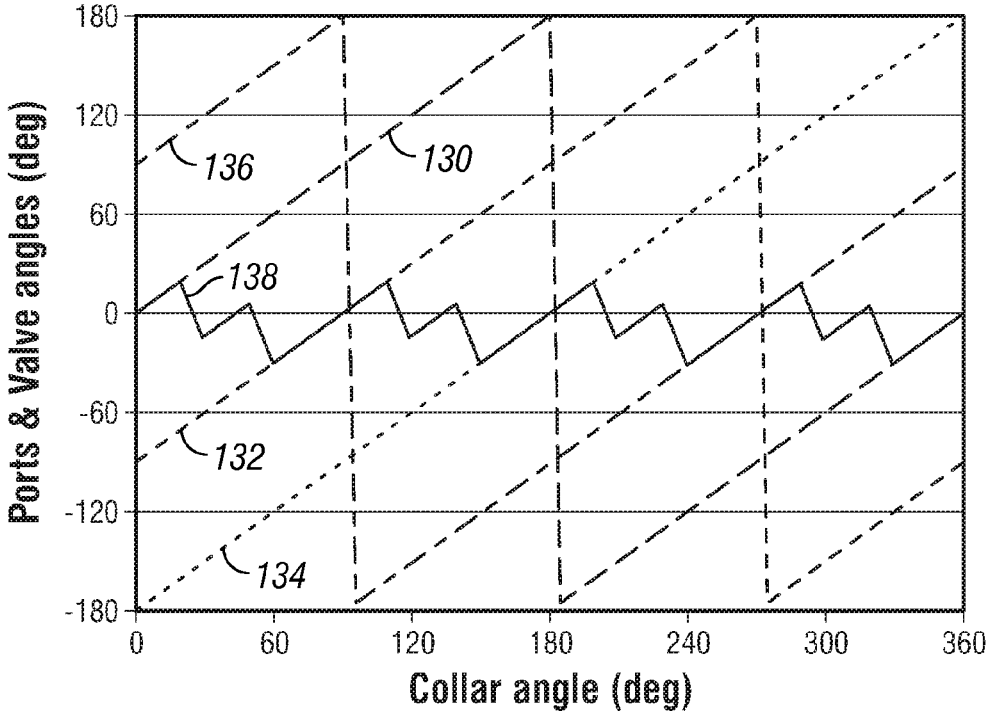
FIG. 31 is a graphical representation showing the drill collar angle versus the angular position of the rotational valve openings and the flow ports during production of side forces from −20° to +20°, according to an embodiment of the present invention.

In FIG. 31, the drill collar angle, as represented by triangular marker 96, is plotted versus the angular position of first (1), second (2), third (3), and fourth (4) ports 92 (see graph lines 130, 132, 134 and 136, respectively) and versus the angular position of the spider valve 66 (see graph line 138). The sequence depicted in FIGS. 30 and 31 shows that the spider valve 66 follows a pattern in a relatively narrow range.

Figure 32:
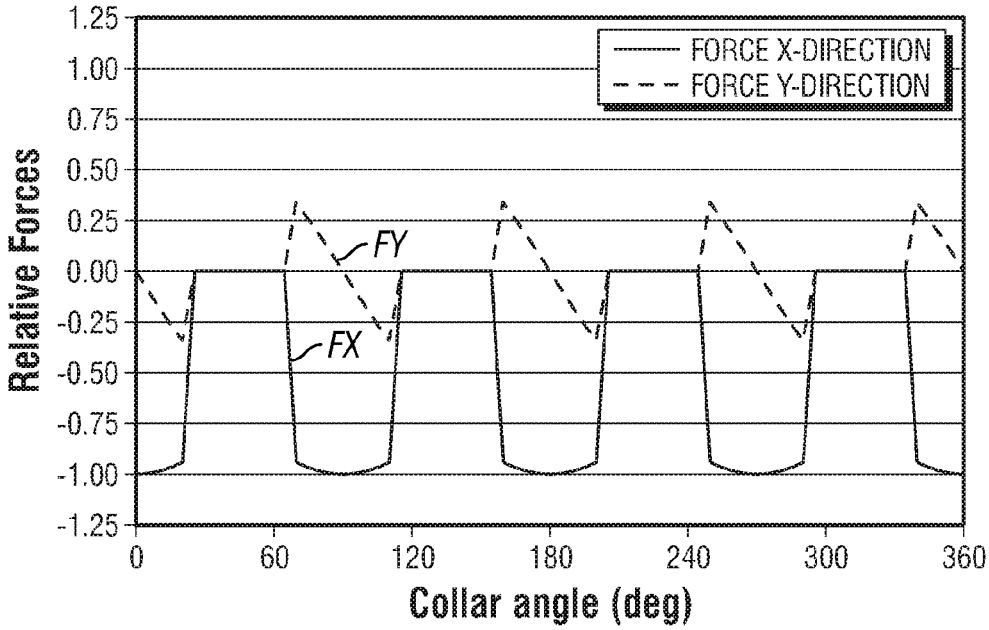
FIG. 32 is a graphical representation showing the drill collar angle versus the relative forces generated in the X and Y directions, according to an embodiment of the present invention.
Figure 33A:
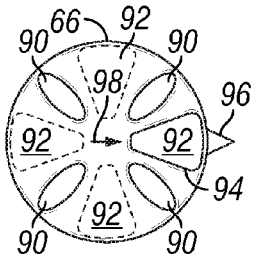
FIG. 33 is a schematic illustration of the corresponding positions of the rotational valve openings and the corresponding flow ports in the example of FIG. 20 during operation of the rotary steerable system when side force is generated between the −10° and +10° angular positions, according to an embodiment of the present invention.
Figure 33B:
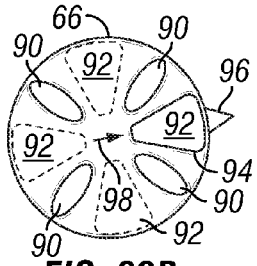
Figure 33C:
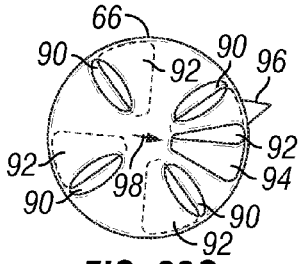
Figure 33D:
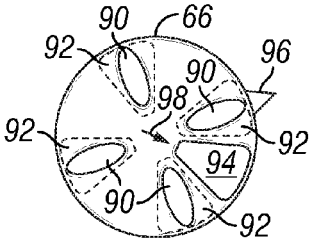
Figure 33E:
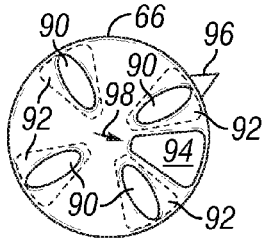
Figure 33F:
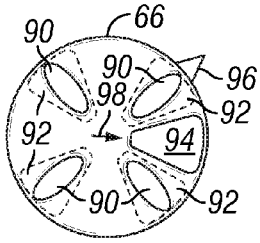
Figure 33G:
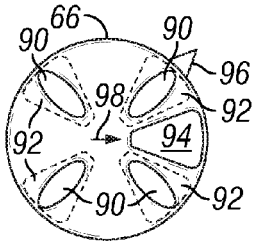
Figure 33H:
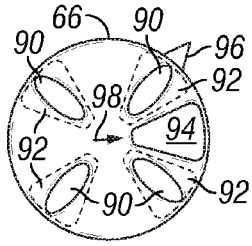
Figure 33I:
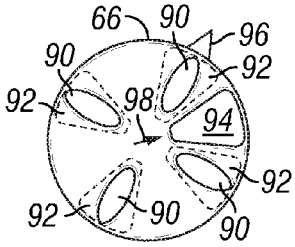
Figure 33J:
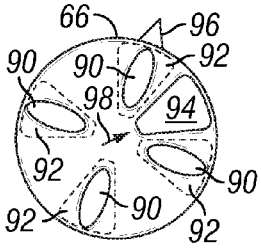
Figure 33K:
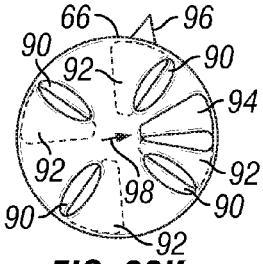
Figure 33L:
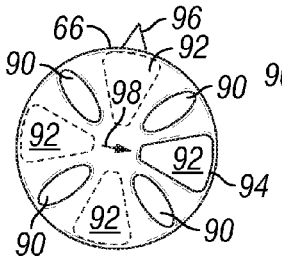
Figure 33M:
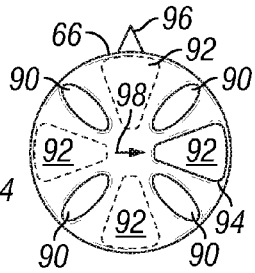

The force components in the x and y directions are illustrated in FIG. 32. As illustrated, four angular ranges occur in each drill collar rotation in which no forces are applied. The maximum force in the y-direction has been significantly reduced, and the force in the x-direction also is reduced, but by a smaller amount. Thus, the application of force is more efficient in deflecting the drill bit in the x-direction because less energy has been expended in the y-direction.

A still greater reduction in dogleg severity is achieved by controlling spider valve 66 according to the sequence of rotational positions illustrated in FIG. 33. This method further reduces the deflection force acting on the rotary steerable system 28 by further restricting the range of drill collar angles over which a single steering pad 30 is activated. The spider valve 66 is rotated in a manner which maintains the spider valve in an "off" position for prolonged periods. In this example, movement of the spider valve 66 is again programmed to create a side force applied to the rotary steerable system 28 by opening a port 92 over a restricted angular range while the other three ports 92 are closed. In the example illustrated in FIG. 33, the side force is applied primarily in a positive x-direction to deflect the rotary steerable system 28 toward the negative x-direction. FIG. 33 illustrates a sequence of drill collar 34 and spider valve 66 rotational movements that produce a smaller side force. The angular positions of the drill collar 34 range from 0° to 90° while the angular positions of the spider valve 66 range between −10° and +10°. The smaller angular range during which the force is applied in the x-direction results in a further reduced dogleg severity.

As illustrated, the spider valve angle is the same as the drill collar angle from 0° to 10°. During this portion of rotation, the large valve opening 94 is maintained in alignment with the first (1) port 92 to enable flow to the corresponding steering pad 30. Once the 10° angular position is reached, the spider valve 66 begins to rotate clockwise. The spider valve 66 then rotates at the same RPM as the drill collar 34 while actuating fluid flows through the four small valve openings 90 and through corresponding ports 92, effectively transitioning the spider valve 66 to the "off" position in which no side force is generated. In this particular example, the spider valve 66 is in this off position for prolonged periods when the drill collar angle lies in the ranges from 15° to 75°, 105° to 265°, 195° to 255°, and 285° to 345°. One result is substantially less force applied in the y-direction. However, the force in the x-direction remains strong but is applied over a much more limited range of angular positions from −10° to +10°.

Figure 34:
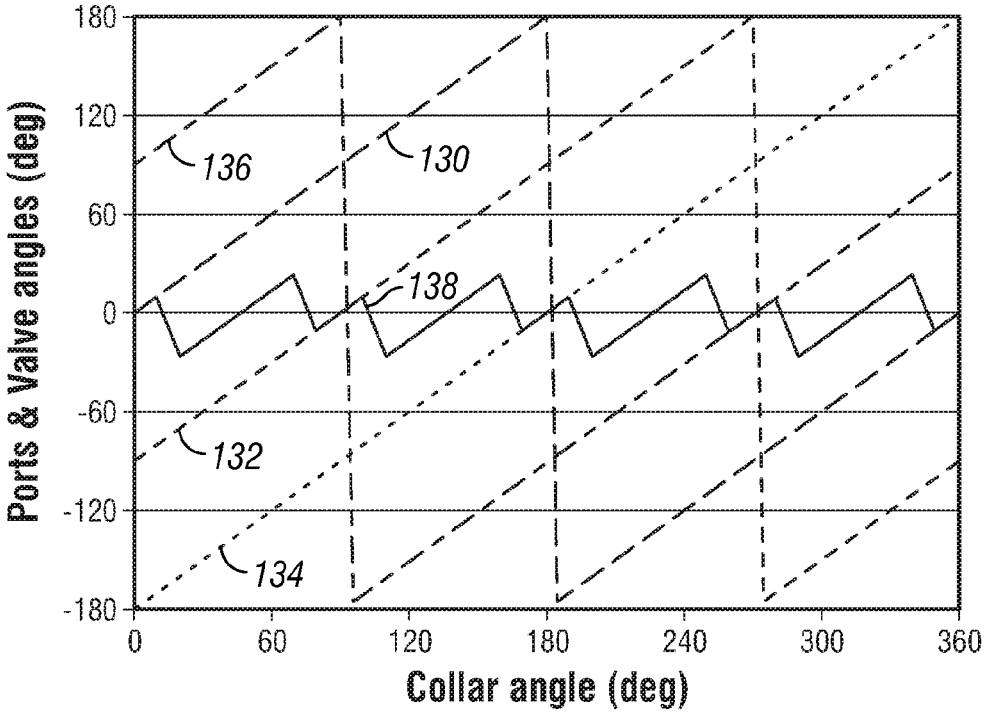
FIG. 34 is a graphical representation showing the drill collar angle versus the angular position of the rotational valve openings and the flow ports during production of side forces from −10° to +10°, according to an embodiment of the present invention.
Figure 35:
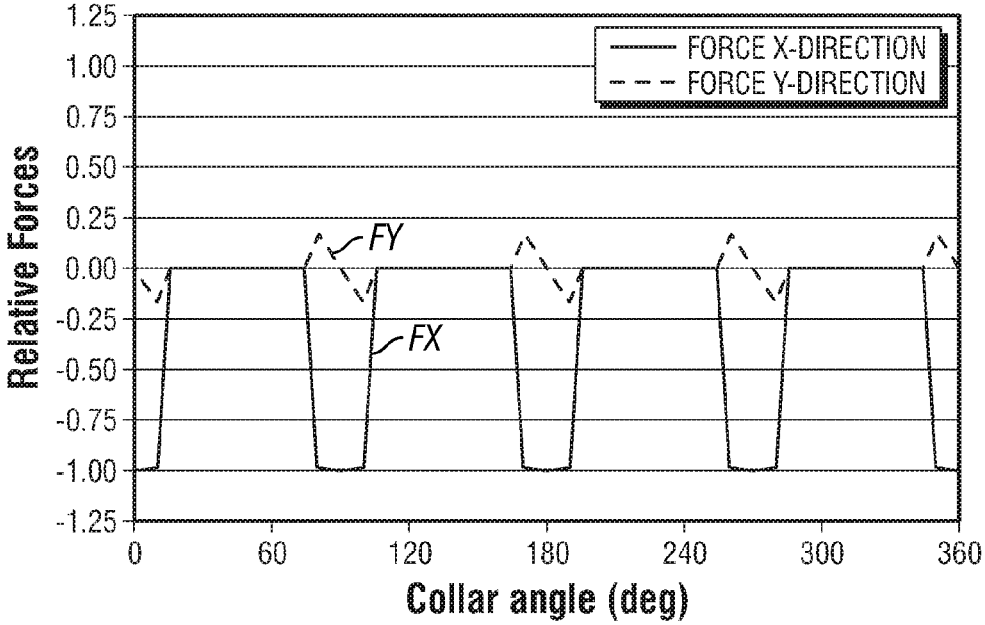
FIG. 35 is a graphical representation showing the drill collar angle versus the relative forces generated in the X and Y directions, according to an embodiment of the present invention.

In FIG. 34, the drill collar angle, as represented by triangular marker 96, is plotted versus the angular position of first (1), second (2), third (3), and fourth (4) ports 92 (see graph lines 130, 132, 134 and 136, respectively) and versus the angular position of the spider valve 66 (see graph line 138). The sequence depicted in FIGS. 33 and 34 shows that the spider valve 66 follows a pattern in which limited side forces are applied. The force components in the x and y directions are illustrated in FIG. 35. As illustrated, four substantial angular ranges occur in each drill collar rotation in which no forces are applied.

Figure 36:
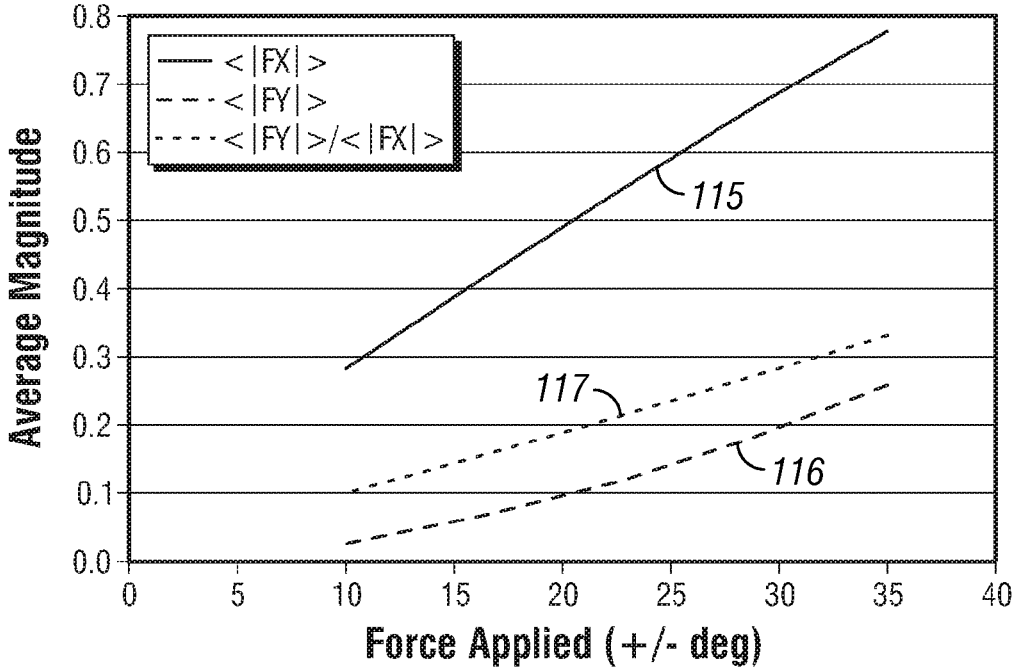
FIG. 36 is a graphical representation showing average forces applied versus activation angles, according to an embodiment of the present invention.
Figure 37A:
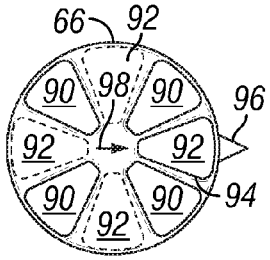
FIG. 37 is a schematic illustration of the corresponding positions of the rotational valve openings and the corresponding flow ports in the example of FIG. 20 during operation of the rotary steerable system when side force is generated between the −30° and +30° angular positions, according to an embodiment of the present invention.
Figure 37B:
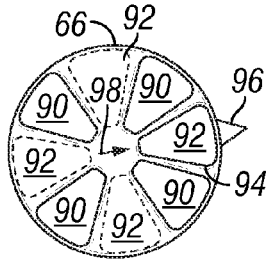
Figure 37C:
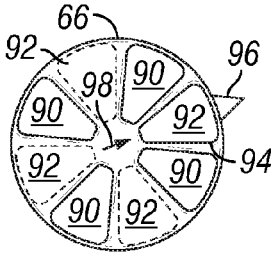
Figure 37D:
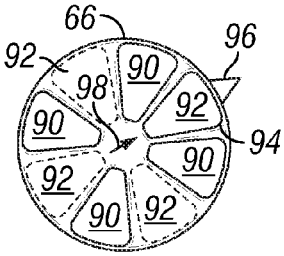
Figure 37E:
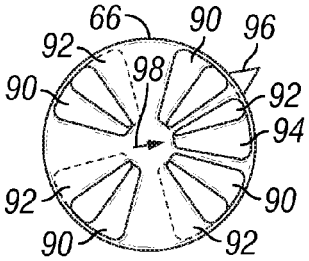
Figure 37F:
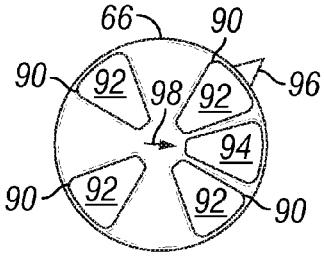
Figure 37G:
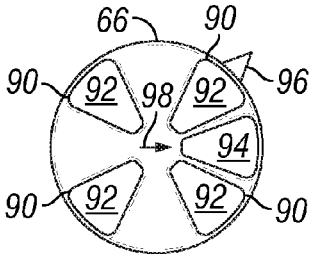
Figure 37H:
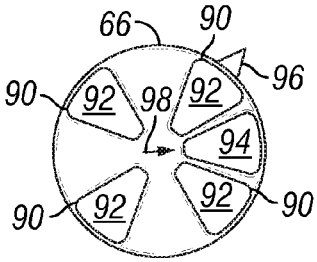
Figure 37I:
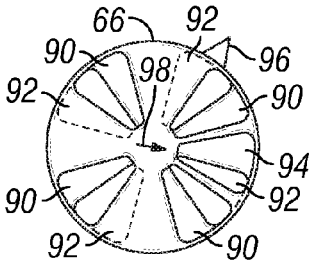
Figure 37J:
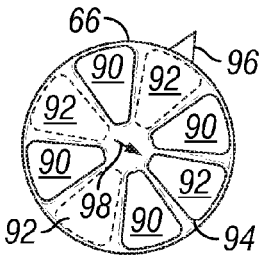
Figure 37K:
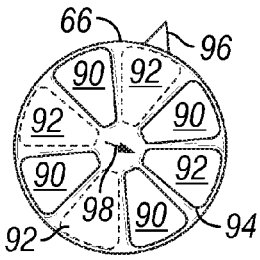
Figure 37L:
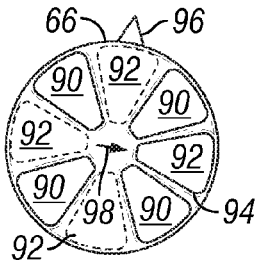
Figure 37M:
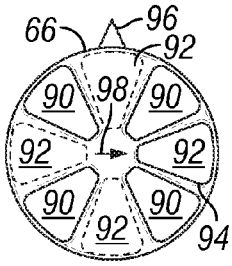

An example of the average forces applied versus the activation angles is illustrated in FIG. 36 which is similar to FIG. 19. The magnitude of the drill bit deflection in the x-direction is given by $$\langle Fx \rangle = \frac{1}{2\pi}\int_0^{2\pi} Fx(\theta)\,d\theta$$

because the sign of Fx is always negative. This quantity is plotted in FIG. 36 versus the range of angles over which the forces applied and labeled with graph line 115. The duration of the force Fx(θ) is related to the angle of the spider valve 66. The maximum value for <|Fx|> is 0.78 for the range of angles from −35° to +35° and the minimum value for <|Fx|> is 0.29 for the range of angles from −10° to +10° in these examples. It should be noted the radial force has a unity magnitude, i.e. F=1. The content illustrated graphically in FIG. 36 can be used in an algorithm to relate dogleg severity to the range of angles over which side forces are applied. This data can be used in a look-up table are simply calculated from a polynomial.

Figure 38:
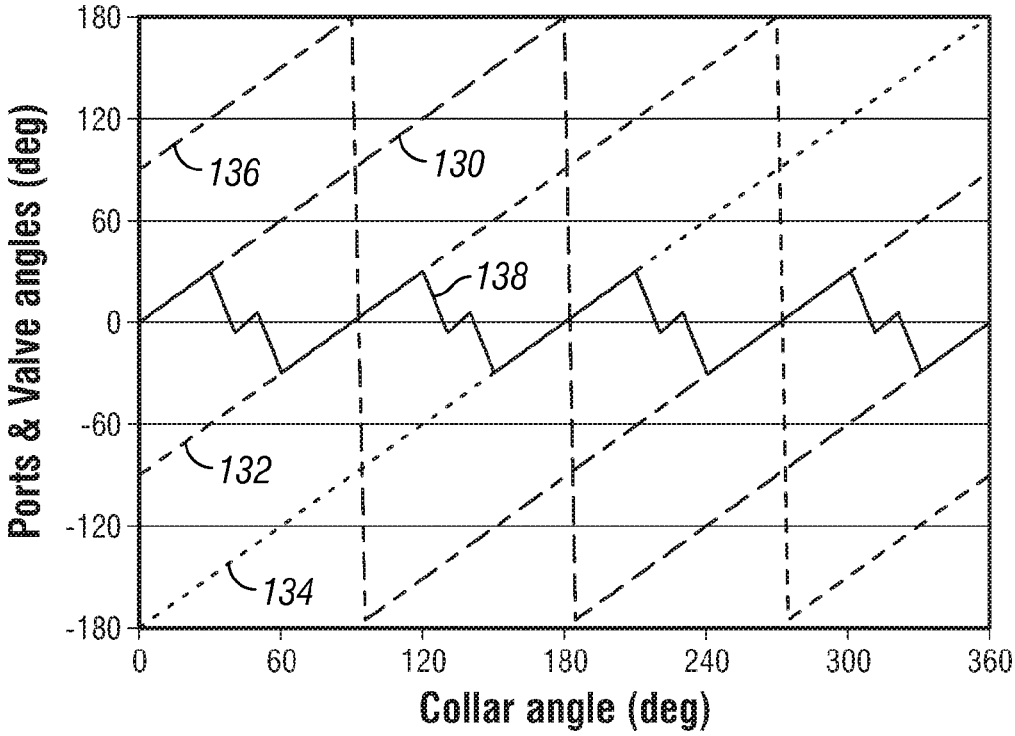
FIG. 38 is a graphical representation showing the drill collar angle versus the angular position of the rotational valve openings and the flow ports during production of side forces from −30° to +30°, according to an embodiment of the present invention.
Figure 39:
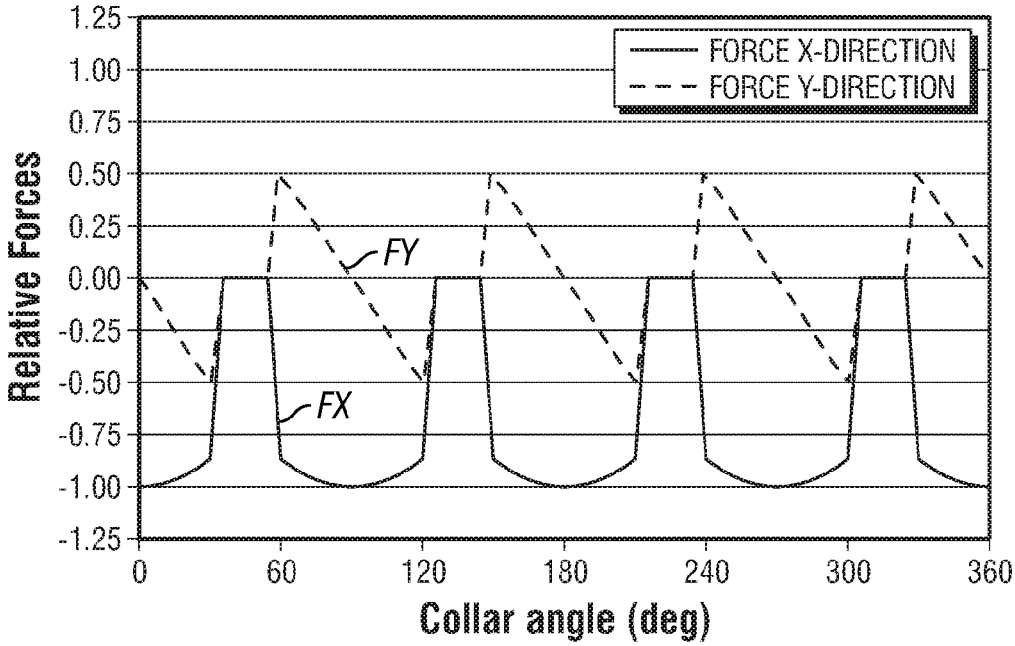
FIG. 39 is a graphical representation showing the drill collar angle versus the relative forces generated in the X and Y directions, according to an embodiment of the present invention.

Referring generally to FIGS. 37-39, another example is illustrated for reducing the deflection force acting on the rotary steerable system 28 by restricting the range of drill collar angles over which a single steering pad 30 is activated. In this example, the spider valve 66 is constructed with relatively large valve openings 90. By way of one specific example, the valve openings 90 may have a width extending through an angular range of 40°. Movement of the spider valve 66 is again programmed to create a side force applied to the rotary steerable system 28 by opening a port 92 over a restricted angular range while the other three ports 92 are closed. In the example illustrated in FIG. 37, the side force is applied primarily in a positive x-direction to deflect the rotary steerable system 28 toward the negative x-direction. FIG. 37 illustrates a sequence of drill collar 34 and spider valve 66 rotational movements that produce a smaller side force. In this example, the angular positions of the drill collar 34 range from 0° to 90° while the angular positions of the spider valve 66 range between −30° and +30°.

In FIG. 38, the drill collar angle, as represented by triangular marker 96, is plotted versus the angular position of first (1), second (2), third (3), and fourth (4) ports 92 (see graph lines 130, 132, 134 and 136, respectively) and versus the angular position of the spider valve 66 (see graph line 138). The sequence depicted in FIGS. 37 and 38 shows that the spider valve 66 follows a pattern in which specifically selected side forces are applied. The force components in the x and y directions are illustrated in FIG. 39. As illustrated, four angular ranges occur in each drill collar rotation in which no forces are applied.

The well drilling system 20 and rotary steerable assembly may be constructed according to a variety of configurations with many types of components. The actual construction of the drilling system and the components selected depend on the type of wellbore desired and the size and shape of the reservoir accessed by the wellbore. For example, numerous types of drill collars, sensing systems, and other components may be incorporated into the drill string. The steering system may utilize a single steering pad 30 or a plurality of steering pads. If a plurality of steering pads is employed, the steering pads may be turned "off" by activating all of the steering pads simultaneously or, alternatively, by deactivating all of the steering pads simultaneously.

Furthermore, the rotational valve system may have a variety of sizes and configurations with three, four, five, or other numbers of valve openings arranged in a desired angular patterns to correspond with actuating fluid ports of the drill collar. The motor employed to operate the rotational valve may be an electric motor of a variety of sizes, configurations and power ratings depending on the parameters of a given application. Furthermore, the control system may comprise a microprocessor or other type of micro-controller which is programmable to operate the rotational valve according to a variety of paradigms for drilling straight and/or deviated sections of wellbore. Additionally, the rotational valve, motor, and control system may be part of various types of drilling assemblies, including point-the-bit assemblies, push-the-bit assemblies, and hybrid assemblies.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for drilling a wellbore, comprising:

a rotary steerable system having:

a drill collar;

a plurality of movable steering pads mounted to the drill collar, the plurality of movable steering pads being hydraulically actuated by a fluid directed through a plurality of ports corresponding with the plurality of movable steering pads;

a rotational valve positioned in the drill collar, the rotational valve having a plurality of openings and an additional opening to control flow of the fluid to the plurality of ports for actuating the plurality of movable steering pads, the plurality of openings matching the number of ports; and an electric motor coupled to the rotational valve, the electric motor being controlled to rotate the rotational valve in a manner which controls flow of fluid to desired ports of the plurality of ports, the additional valve opening being located to enable flow through specific ports to specific movable steering pads and the plurality of openings being positioned to enable alignment of the plurality of openings with the plurality of ports to enable simultaneous flow of the fluid to all of the plurality of movable steering pads while the additional valve opening is closed.

2. The system as recited in claim 1, wherein the plurality of movable steering pads comprises three movable steering pads, and the plurality of ports comprises three ports positioned at angular positions 120° apart.

3. The system as recited in claim 1, wherein the plurality of movable steering pads comprises four movable steering pads, and the plurality of ports comprises four ports positioned at angular positions 90° apart.

4. The system as recited in claim 1, wherein the rotary steerable system further comprises an encoder positioned to measure an angular position of the rotational valve relative to the drill collar.

5. The system as recited in claim 4, wherein the rotary steerable system further comprises control electronics, the electric motor and the encoder being coupled to the control electronics.

6. The system as recited in claim 5, wherein the electric motor, encoder, and control electronics are located within a pressure housing within the drill collar.

7. The system as recited in claim 5, wherein the rotary steerable system further comprises a power source located within the drill collar.

8. The system as recited in claim 7, wherein the power source comprises a turbine.

9. The system as recited in claim 1, wherein the rotational valve is rotated by the electric motor to direct the fluid through the plurality of ports in a manner which causes individual movable steering pads of the plurality of steering pads to extend while within a desired angular range of rotation of the drill collar.

10. The system as recited in claim 1, wherein the rotational valve is rotated by the electric motor to direct the fluid through all of the plurality of ports simultaneously to cause drilling of a straight section of the wellbore.

11. The system as recited in claim 1, wherein the rotation of the rotational valve is selectively changed to change the severity of a dogleg being formed during drilling of the wellbore.

12. A method of forming a wellbore, comprising:

mounting a rotational valve in a drill collar to control flow of an actuating fluid to a plurality of movable steering pads via selective movement of a plurality of openings and an additional opening in the rotational valve into and out of communication with desired ports which rotate with the drill collar during drilling;

arranging the plurality of openings to enable alignment of the plurality of openings with the desired ports for simultaneous flow of actuating fluid to all of the plurality of movable steering pads;

positioning the additional opening to enable selective flow of the actuating fluid to specific movable steering pads of the plurality of steering pads and to enable closing of the additional opening during the simultaneous flow of actuating fluid to all of the plurality of movable steering pads; and coupling a motor to the rotational valve to rotate the rotational valve in a manner which controls flow of the actuating fluid into the ports via the plurality of openings and the additional opening to enable selective orienting of the drill collar through actuation of the plurality of movable steering pads.

13. The system as recited in claim 12, further comprising controlling the motor via a micro-controller positioned with the motor at a location within the drill collar.

14. The system as recited in claim 13, further comprising employing an encoder to provide data to the micro-controller on the relative angular position of the rotational valve with respect to the drill collar.

15. The system as recited in claim 14, further comprising rotating a bit with the drill collar to drill the wellbore.

16. The system as recited in claim 12, further comprising forming the rotational valve with three openings angularly spaced to enable simultaneous flow into three corresponding ports for simultaneous actuation of the corresponding, movable steering pads, wherein forming further comprises forming the rotational valve with the additional opening as a fourth opening which may be selectively rotated into cooperation with the three corresponding ports to control a desired directional drilling of a deviated section of the wellbore.

17. The system as recited in claim 12, further comprising forming the rotational valve with four openings angularly spaced to enable simultaneous flow into four corresponding ports for simultaneous actuation of the corresponding, movable steering pads, wherein forming further comprises forming the rotational valve with the additional opening as a fifth opening which may be selectively rotated into cooperation with the four corresponding ports to control a desired directional drilling of a deviated section of the wellbore.

18. A method of drilling a wellbore, comprising:

selectively actuating steering pads on a drill collar of a rotary steerable system via an actuating fluid;

controlling flow of the actuating fluid to the actuating steering pads with a motor controlled rotational valve;

providing the motor controlled rotational valve with a plurality of openings matching the number of steering pads and an additional opening such that the plurality of openings and the additional opening have a fixed angular displacement with respect to each other; and rotating the motor controlled rotational valve at a plurality of different speeds to provide the desired flow of actuating fluid to the steering pads selectively through the plurality of openings and the additional opening to provide directional control over the rotary steerable system.

19. The method as recited in claim 18, wherein controlling comprises coupling an electric motor to a rotational valve of the motor controlled rotational valve and to a micro-controller receiving feedback on the angular position of the rotational valve relative to the angular position of the drill collar.

20. The method as recited in claim 18, further comprising porting the rotational valve to enable the rotational valve to be rotated in a manner which simultaneously actuates all of the steering pads.

* * * * *